US008917579B2

(12) United States Patent
Takasawa

(10) Patent No.: US 8,917,579 B2
(45) Date of Patent: Dec. 23, 2014

(54) MANUFACTURING METHOD OF TIMEPIECE DIAL, TIMEPIECE DIAL, AND TIMEPIECE

(75) Inventor: Koki Takasawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/569,594

(22) Filed: Aug. 8, 2012

(65) Prior Publication Data

US 2013/0044573 A1 Feb. 21, 2013

(30) Foreign Application Priority Data

Aug. 18, 2011 (JP) ..... 2011-179144
Sep. 7, 2011 (JP) ..... 2011-195120

(51) Int. Cl.
*G04D 3/00* (2006.01)
*G04B 19/06* (2006.01)
*G04B 19/10* (2006.01)

(52) U.S. Cl.
CPC ..... *G04B 19/10* (2013.01); *G04D 3/0092* (2013.01)
USPC ..... 368/232; 368/234; 368/205

(58) Field of Classification Search
USPC ..... 368/205, 223, 232, 234
See application file for complete search history.

(56) References Cited

U.S. PATENT DOCUMENTS

| | | | | |
|---|---|---|---|---|
| 3,449,158 | A * | 6/1969 | Rowland | 156/209 |
| 4,541,727 | A * | 9/1985 | Rosenthal | 368/232 |
| 5,723,200 | A * | 3/1998 | Oshima et al. | 428/172 |
| 6,414,794 | B1 * | 7/2002 | Rosenthal | 359/619 |
| 6,856,462 | B1 * | 2/2005 | Scarbrough et al. | 359/619 |
| 2002/0001132 | A1 * | 1/2002 | Nishikawa | 359/619 |
| 2004/0032797 | A1 * | 2/2004 | Sato et al. | 368/232 |
| 2005/0162747 | A1 * | 7/2005 | Shimizu | 359/619 |
| 2008/0036196 | A1 * | 2/2008 | Steenblik et al. | 283/109 |
| 2008/0159083 | A1 * | 7/2008 | Kawakami | 368/232 |
| 2009/0073565 | A1 * | 3/2009 | Hsu et al. | 359/599 |
| 2009/0126792 | A1 * | 5/2009 | Gruhlke et al. | 136/259 |
| 2009/0129210 | A1 * | 5/2009 | Yamaguchi et al. | 368/205 |
| 2010/0046103 | A1 * | 2/2010 | Yeh et al. | 359/831 |
| 2010/0182666 | A1 * | 7/2010 | Herbert et al. | 359/200.7 |
| 2011/0037736 | A1 * | 2/2011 | Epstein et al. | 345/204 |
| 2011/0209328 | A1 * | 9/2011 | Steenblik et al. | 29/428 |
| 2011/0255171 | A1 * | 10/2011 | Endle et al. | 359/619 |

FOREIGN PATENT DOCUMENTS

JP 02-306188 A 12/1990

* cited by examiner

*Primary Examiner* — Amy Cohen Johnson
*Assistant Examiner* — Matthew Powell
(74) *Attorney, Agent, or Firm* — Global IP Counselors, LLP

(57) ABSTRACT

To provide a timepiece dial that presents a rich stereoscopic effect, and to provide a timepiece comprising the timepiece dial, the timepiece dial of the invention comprises a microlens layer composed of a plurality of microlenses arranged in an orderly fashion as viewed in a planar view, and a decorative layer composed of a repeating design having a plurality of constituent units. As viewed in a planar view, the microlens layer and the decorative layer are superimposed, and the decorative layer has regions where pitches of the constituent units that are adjacent are different from each other.

19 Claims, 15 Drawing Sheets

MANUFACTURING METHOD OF TIMEPIECE DIAL, TIMEPIECE DIAL, AND TIMEPIECE

CROSS-REFERENCE TO RELATED APPLICATIONS

This application claims priority to Japanese Patent Application No. 2011-179144 filed on Aug. 18, 2011 and Japanese Patent Application No. 2011-195120 filed on Sep. 7, 2011. The entire disclosure of Japanese Patent Application Nos. 2011-179144 and 2011-195120 is hereby incorporated herein by reference.

BACKGROUND

1. Technical Field

The present invention relates to a manufacturing method of a timepiece dial, a timepiece dial, and a timepiece.

2. Background Technology

Timepieces and timepiece dials require functionality as a commercial product and decorative aspects (an aesthetic appearance) as a decorative ornament. Well-know dials for a timepiece are typically composed of a metal material in order to yield an appearance that imparts a sense of luxury. However, with a well-known timepiece dial, the range of the appearance that can be expressed is limited and it is not possible to sufficiently respond to consumer needs.

For example, there is considerable need for a timepiece provided with a dial that presents an appearance having a stereoscopic effect, and a timepiece dial has been proposed in which a plurality of designs and other patterns are formed and layered in alternating fashion with transparent films (see Patent Document 1).

However, with such a timepiece dial, a stereoscopic effect having a thickness equal to or greater than that of the timepiece dial cannot be expressed, and it is also difficult to significantly increase the thickness of the timepiece dial itself due to thickness limitations. Therefore, needs such as those described above cannot be sufficiently met. In the particular case of the dial applied to a portable timepiece such as a wristwatch, there is a considerable limitation to the thickness of the timepiece overall, and it is very difficult to achieve an appearance having a rich stereoscopic effect.

Japanese Laid-open Patent Application No. 2-306188 (Patent Document 1) is an example of the related art.

SUMMARY

Problems to be Solved by the Invention

An advantage of the invention is a method for manufacturing a timepiece dial that presents an appearance having stereoscopic effect. Specifically, the advantage of the invention is to provide a method for efficiently manufacturing plural types of timepiece dials that present a different appearance, to provide a timepiece dial that presents an appearance having a rich stereoscopic effect, and also, to provide a timepiece composed of the timepiece dial.

Means Used to Solve the Above-Mentioned Problems

The objects described above are achieved by the invention described below. A method for manufacturing a timepiece dial of the invention comprises a microlens layer preparing process for preparing a microlens layer composed of a plurality of microlenses arranged in an orderly fashion as viewed in a planar view; and a decorative layer forming process for forming a decorative layer composed of a repeating design having a plurality of constituent units in an orderly fashion, superimposing the microlens layer and the decorative layer as viewed in a planar view of the microlens layer, forming the decorative layer on a surface which is opposite side of a lens surface of the microlens layer; wherein the constituent units of the repeating design have an arrangement, which is the same arrangement as the microlenses, compressed or expanded in an in-plane predetermined direction of the decorative layer. It is thus possible to provide a method for manufacturing a timepiece dial that presents an appearance having a rich stereoscopic effect. Specifically, the manufacturing method can be provided for efficiently manufacturing plural types of timepiece dials that present a different appearance.

In the manufacturing method of the timepiece dial of the invention, it is preferable that in a case where the centers of the microlenses that are adjacent as viewed in a planar view of the timepiece dial are connected by a straight line, a plurality of equilateral triangles are arranged in an orderly fashion by the straight line, and in a case where the centers of the repeating design that are adjacent as viewed in the planar view of the timepiece dial are connected by a straight line, a plurality of isosceles triangles, which are not equilateral triangles, are arranged in an orderly fashion by the straight line. Thus, a more particularly excellent aesthetic appearance can be imparted to the timepiece dial. Also, by adjusting the relative angle between the microlens layer and the decorative layer, the adjustment of the appearance of the timepiece dial can be more advantageously processed.

In the manufacturing method of the timepiece dial of the invention, it is preferable that in a case where the centers of the microlenses that are adjacent as viewed in a planar view of the timepiece dial are connected by a straight line, a plurality of squares are arranged in an orderly fashion by the straight line, and in a case where the centers of the repeating design that are adjacent as viewed in a planar view of the timepiece dial are connected by a straight line, a plurality of rectangles, which are not squares, are arranged in an orderly fashion by the straight line. Thus, a more particularly excellent aesthetic appearance can be imparted to the timepiece dial. Also, by adjusting the relative angle between the microlens layer and the decorative layer, the adjustment of the appearance of the timepiece dial can be more advantageously processed.

In the manufacturing method of the timepiece dial of the invention, it is preferable that a distance from the lens surface of the microlenses to the surface of the decorative layer in the timepiece dial is 100 μm or more and 1000 μm or less. Thus, an appearance of the timepiece dial can be provided with a rich stereoscopic effect, and a more particularly excellent aesthetic appearance can be imparted to the timepiece dial. Also, by adjusting the relative angle between the microlens layer and the decorative layer, the adjustment of the appearance of the timepiece dial can be more advantageously processed.

In the manufacturing method of the timepiece dial of the invention, it is preferable that a focal distance of the microlenses is 100 μm or more and 1000 μm or less. Thus, a more particularly excellent aesthetic appearance can be imparted to the timepiece dial. Also, by adjusting the relative angle between the microlens layer and the decorative layer, the adjustment of the appearance of the timepiece dial can be more advantageously processed.

In the manufacturing method of the timepiece dial of the invention, it is preferable that a pitch of the microlenses is 50 μm or more and 500 μm or less. Thus, a more particularly excellent aesthetic appearance can be imparted to the timepiece dial. Also, by adjusting the relative angle between the microlens layer and the decorative layer, the adjustment of the appearance of the timepiece dial can be more advantageously processed.

In the manufacturing method of the timepiece dial of the invention, it is preferable that a pitch of the constituent units of the repeating design is 40 μm or more and 550 μm or less. Thus, a more particularly excellent aesthetic appearance can be imparted to the timepiece dial. Also, by adjusting the relative angle between the microlens layer and the decorative layer, the adjustment of the appearance of the timepiece dial can be more advantageously processed.

In the manufacturing method of the timepiece dial of the invention, it is preferable that a focal distance $L_0$ [μm] of the microlenses and a distance $L_1$ [μm] from the lens surface of the microlenses to the surface of the decorative layer satisfy the relationship of $0.5 \leq L_1/L_0 \leq 1.5$. Thus, an appearance of the timepiece dial can be provided with a rich stereoscopic effect, and a more particularly excellent aesthetic appearance can be imparted to the timepiece dial. Also, by adjusting the relative angle between the microlens layer and the decorative layer, the adjustment of the appearance of the timepiece dial can be more advantageously processed.

In the manufacturing method of the timepiece dial of the invention, it is preferable that a pitch $P_{ML}$ [μm] of the microlenses and a pitch $P_R$ [μm] of the constituent units of the repeating design satisfy the relationship of $0.5 \leq P_R/P_{ML} \leq 1.5$. Thus, an appearance of the timepiece dial can be provided with a rich stereoscopic effect, and a more particularly excellent aesthetic appearance can be imparted to the timepiece dial. Also, by adjusting the relative angle between the microlens layer and the decorative layer, the adjustment of the appearance of the timepiece dial can be more advantageously processed.

In the manufacturing method of the timepiece dial of the invention, it is preferable that in at least a portion where time characters are not provided, the repeating design of the decorative layer and the microlenses of the microlens layer are provided as viewed in the planar view of the timepiece of dial, and in a portion where the time characters are provided, the repeating design of the decorative layer and/or the microlenses of the microlens layer are not provided. Thus, a particularly excellent time visibility as well as an excellent aesthetic appearance can be imparted to the timepiece dial, and it is possible to achieve a higher level of both practicality as a commercial product and an aesthetic appearance as a decoration.

In the timepiece dial of the invention, it is preferable that the timepiece dial is manufactured by using the method of the invention. It is thus possible to provide a timepiece dial that presents an appearance having a rich stereoscopic effect.

A timepiece dial of the invention comprises a microlens layer composed of a plurality of microlenses arranged in an orderly fashion as viewed in a planar view; and a decorative layer composed of a repeating design having a plurality of constituent units; wherein the microlens layer and the decorative layer are superimposed as viewed in a planar view, and the decorative layer has regions where pitches of the constituent units that are adjacent are different from each other. It is thus possible to provide a timepiece dial that presents an appearance having a rich stereoscopic effect.

In the timepiece dial of the invention, it is preferable that when $P_{ML}$ [μm] is a pitch of the microlenses and $P_R$ [μm] is a pitch of the constituent units of the repeating design, as viewed in a planar view of the timepiece dial, the timepiece dial has a region where a value of $P_{ML}-P_R$ is gradually increased from a center of the timepiece dial to a circumference part. It is thus possible to cause an observer to discern the depth increased from the center of the timepiece dial to the circumference part (for example, a dome-shaped timepiece dial can be discerned).

In the timepiece dial of the invention, it is preferable that when $P_{ML}$ [μm] is the pitch of the microlenses and $P_R$ [μm] is the pitch of the constituent units of the repeating design, as viewed in the planar view of the timepiece dial, the timepiece dial has a region where the value of $P_{ML}-P_R$ is gradually reduced from the center of the timepiece dial to the circumference part. It is thus possible to cause an observer to discern the depth increased from the circumference part to the center of the timepiece dial (for example, a mortar-shaped timepiece dial can be discerned).

In the timepiece dial of the invention, it is preferable that the constituent units of the repeating design have an arrangement which is the same arrangement as the microlenses, and/or an arrangement compressed or expanded in an in-plane predetermined direction of the decorative layer. Thus, a more particularly excellent aesthetic appearance can be imparted to the timepiece dial. In the timepiece dial of the invention, it is preferable that in a case where the centers of the microlenses that are adjacent as viewed in a planar view of the timepiece dial are connected by a straight line, a plurality of equilateral triangles are arranged in an orderly fashion by the straight line, and in a case where the centers of the repeating design that are adjacent as viewed in the planar view of the timepiece dial are connected by a straight line, a plurality of equilateral triangles, are arranged in an orderly fashion by the straight line. Thus, a more particularly excellent aesthetic appearance can be imparted to the timepiece dial.

In the timepiece dial of the invention, it is preferable that in a case where the centers of the microlenses that are adjacent as viewed in a planar view of the timepiece dial are connected by a straight line, a plurality of squares are arranged in an orderly fashion by the straight line, and in a case where the centers of the repeating design that are adjacent as viewed in a planar view of the timepiece dial are connected by a straight line, a plurality of trapezoids are arranged in an orderly fashion by the straight line. Thus, a more particularly excellent aesthetic appearance can be imparted to the timepiece dial.

In the timepiece dial of the invention, it is preferable that in at least a portion where time characters are not provided, the repeating design of the decorative layer and the microlenses of the microlens layer are provided as viewed in the planar view of the timepiece of dial, and in a portion where the time characters are provided, the repeating design of the decorative layer and/or the microlenses of the microlens layer are not provided. Thus, a particularly excellent time visibility as well as an excellent aesthetic appearance can be imparted to the timepiece dial, and it is possible to achieve a higher level of both practicality as a commercial product and an aesthetic appearance as a decoration.

The timepiece of the invention has the timepiece dial of the invention. It is thus possible to provide a timepiece having a timepiece dial that presents an appearance having a rich stereoscopic effect.

Effect of the Invention

According to the invention, a method for manufacturing a timepiece dial that presents an appearance having a rich stereoscopic effect can be provided. Specifically, the invention is related to a method for efficiently manufacturing plural types of timepiece dials that present a different appearance, a timepiece dial that presents an appearance having a rich stereoscopic effect, and also a timepiece composed of the timepiece dial.

BRIEF DESCRIPTION OF THE DRAWINGS

Referring now to the attached drawings which form a part of this original disclosure:

FIG. 9 is a plan view showing the appearance of the timepiece dial with the arrangement as shown in FIG. 6;

FIG. 10 is a plan view showing the appearance of the timepiece dial with the arrangement as shown in FIG. 7;

FIG. 11 is a plan view showing the appearance of the timepiece dial with the arrangement as shown in FIG. 8;

DETAILED DESCRIPTION OF EXEMPLARY EMBODIMENTS

Preferred embodiments of the invention will be described below with reference to the accompanying drawings. A preferred embodiment of the manufacturing method of the timepiece dial of the invention will be described first.

Manufacturing Method of the Timepiece Dial

Figure 1A:
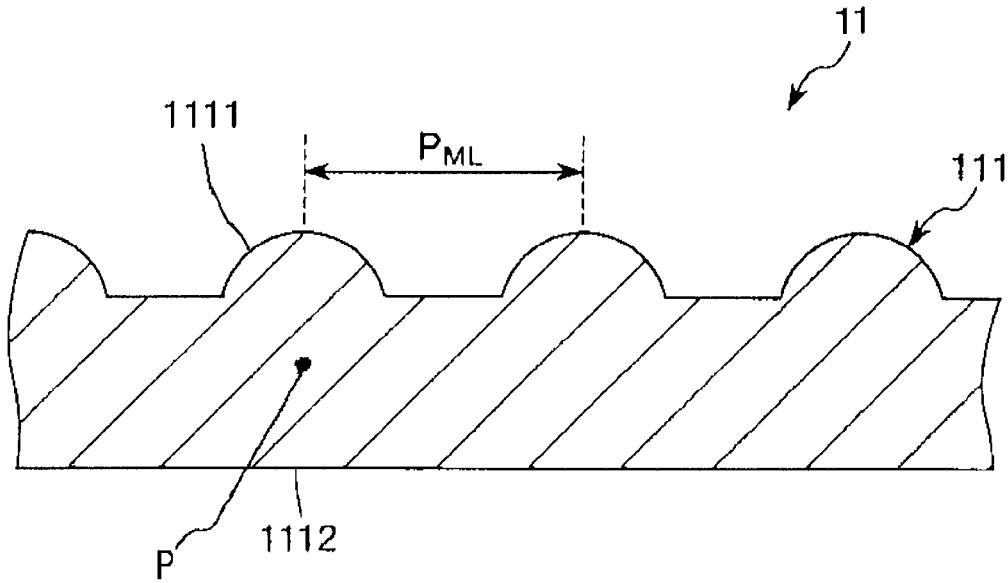
FIG. 1 is a cross-sectional view of a preferred embodiment of the manufacturing method of the timepiece dial.
Figure 1B:
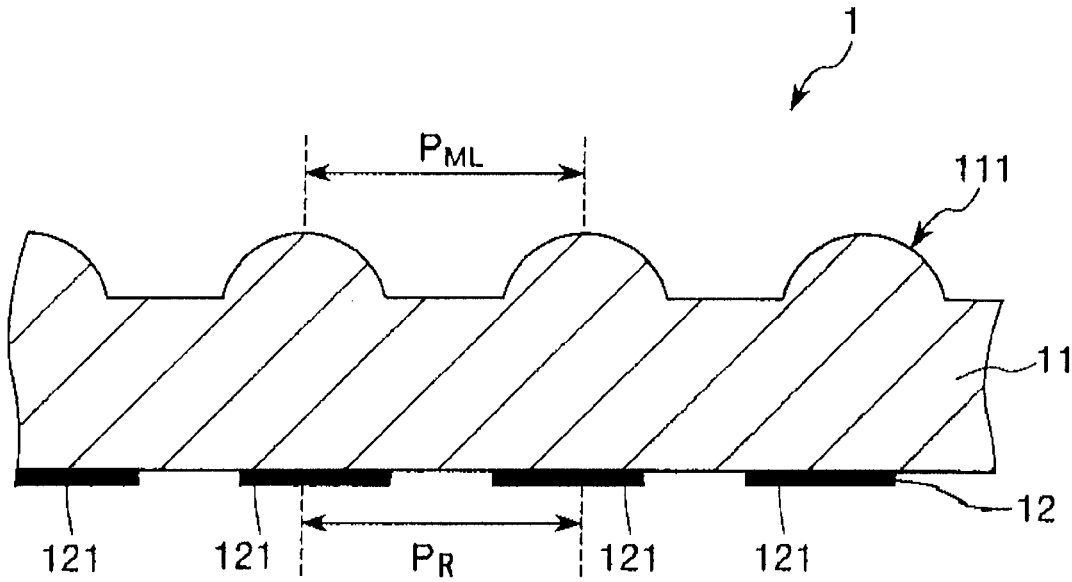
Figure 2:
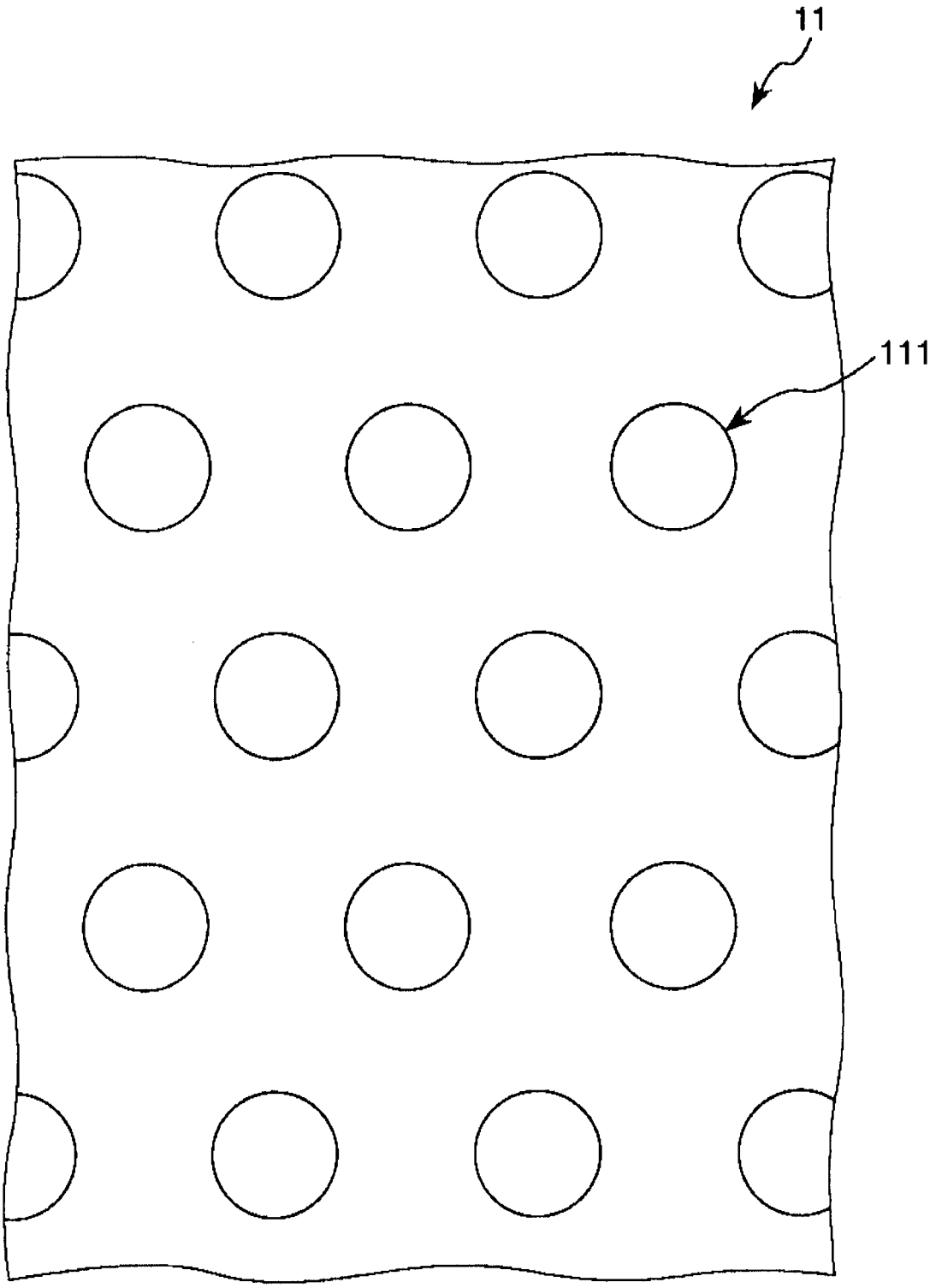
FIG. 2 is a plan view showing one of the examples of the microlens layer (microlens baseplate) used for the production of the timepiece dial.
Figure 3:
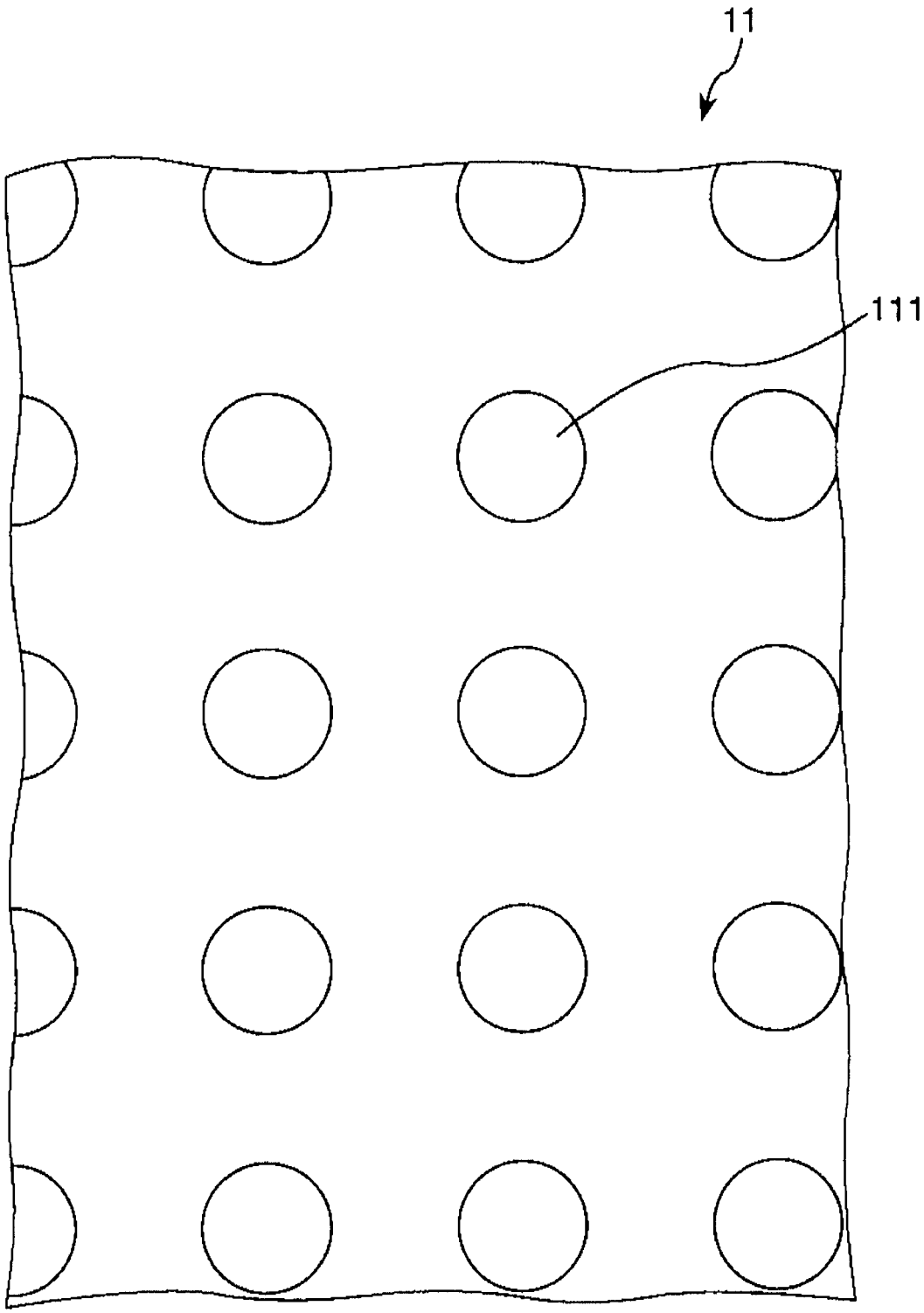
FIG. 3 is a plan view showing another example of the microlens layer (microlens baseplate) used for the production of the timepiece dial.
Figure 4:
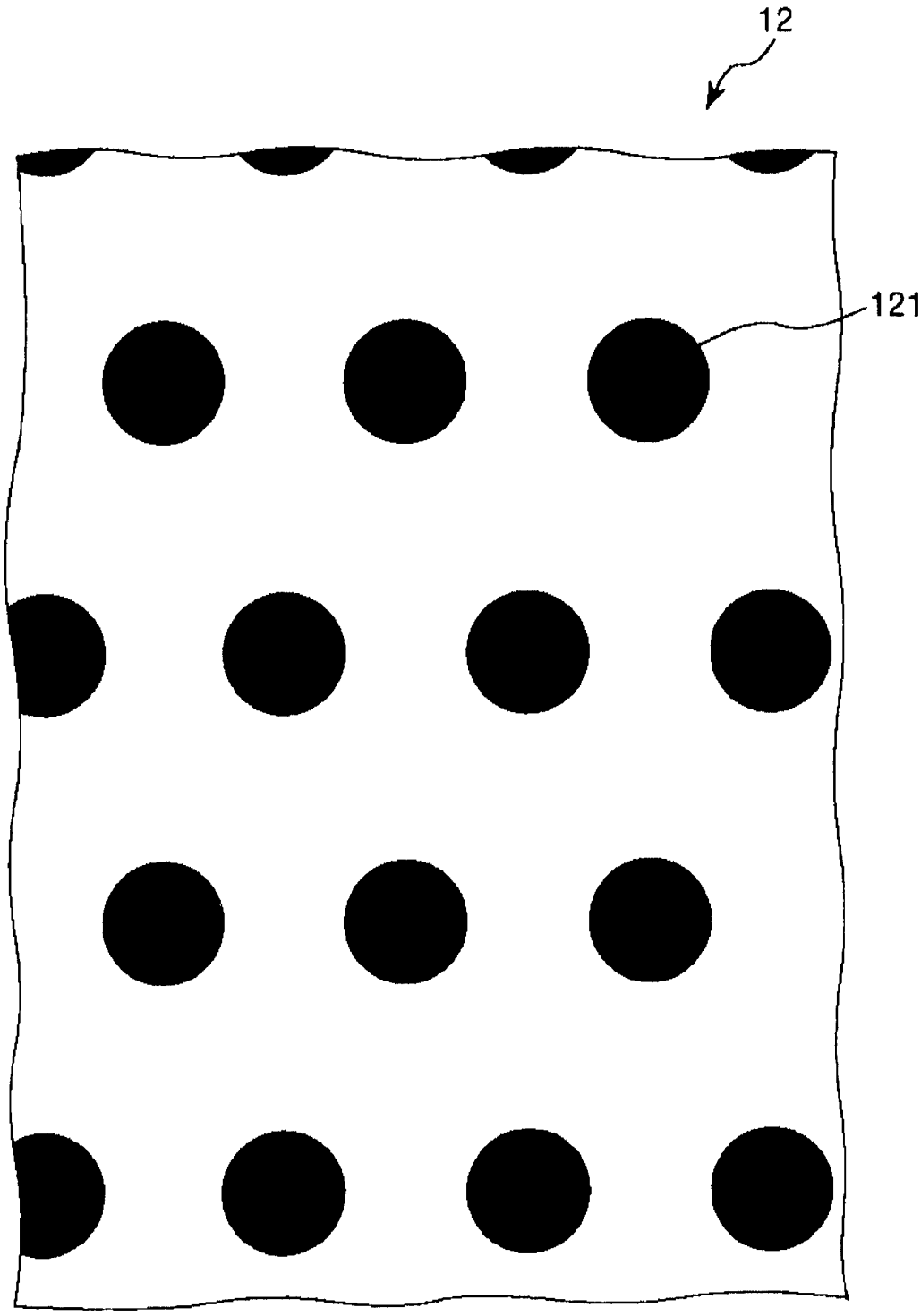
FIG. 4 is a plan view showing one of the examples of an arrangement of a repeating design in the decorative layer.
Figure 5:
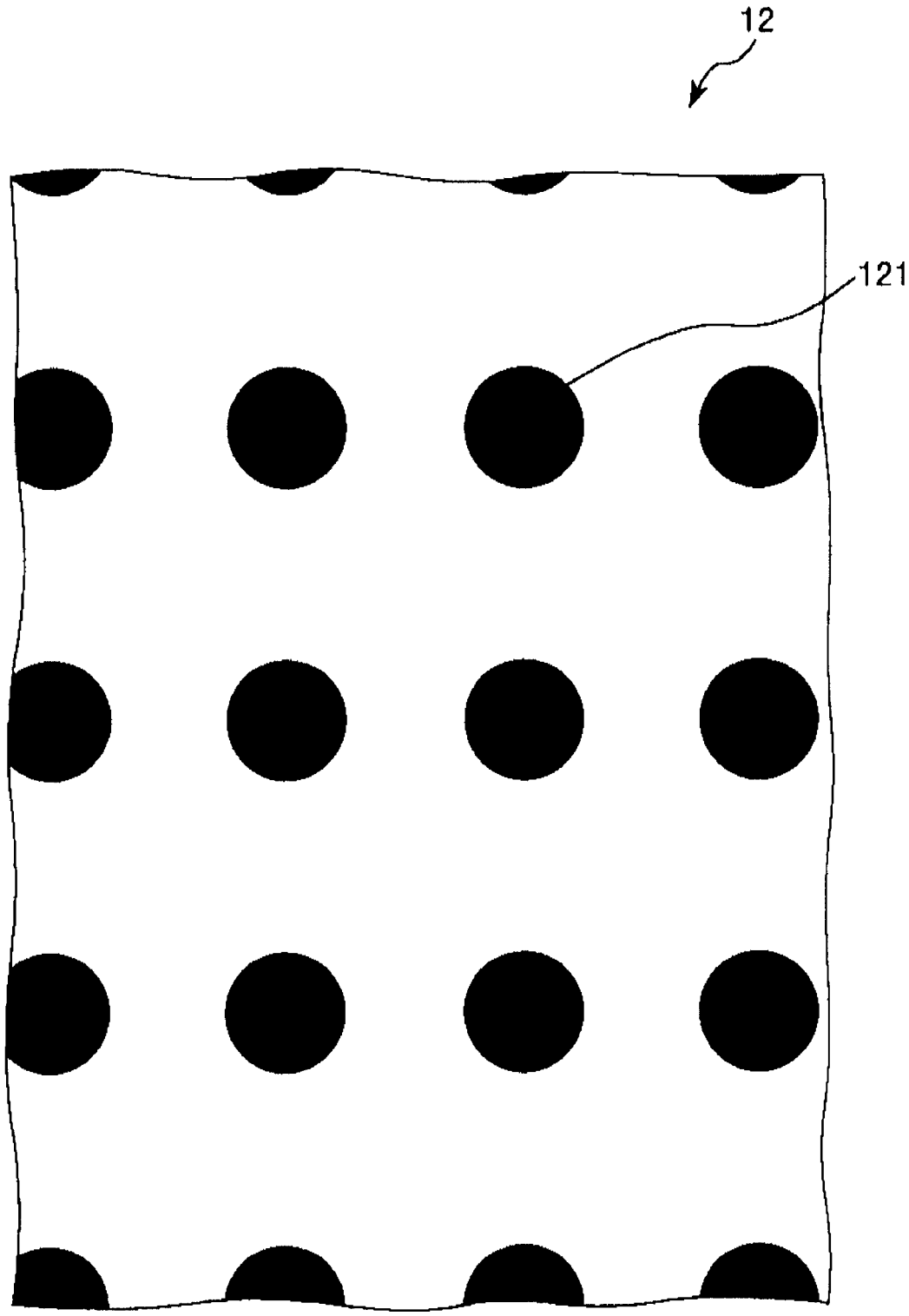
FIG. 5 is a plan view showing another example of an arrangement of a repeating design in the decorative layer.

FIG. 1 is a cross-sectional view of a preferred embodiment of the manufacturing method of the timepiece dial; FIG. 2 is a plan view showing one of the examples of the microlens layer (microlens baseplate) used for the production of the timepiece dial; FIG. 3 is a plan view showing another example of the microlens layer (microlens baseplate) used for the production of the timepiece dial; FIG. 4 is a plan view showing one of the examples of an arrangement of a repeating design in the decorative layer; and FIG. 5 is a plan view showing another example of an arrangement of a repeating design in the decorative layer. The drawings referred to in the present specification show part of the configuration in an exaggerated fashion, and they do not reflect actual dimensions etc. correctly.

As shown in FIG. 1, the manufacturing method of the timepiece dial of the invention includes a microlens preparation process (1*a*) for preparing a microlens layer (microlens baseplate) 11 having a plurality of microlenses 111 arranged in an orderly fashion when the microlens layer is viewed from above, and a decorative layer formation process (1*b*) for forming the decorative layer 12 located in a surface 1112, which is opposite side of the lens surface 1111 of the microlens layer 11, and the decorative layer 12 having a repeating design 121 in which a plurality of the constituent units are arranged in an orderly fashion.

Microlens Layer Preparing Process

As described above, the microlens layer 11 has a plurality of microlenses 111 arranged in an orderly fashion. In the configuration shown in FIG. 2, the plurality of microlenses 111 are arranged such that in a case where the centers of microlenses 111 that are adjacent when the timepiece dial 1 is viewed from above are connected by a straight line, a plurality of triangles are arranged in an orderly fashion by the straight line. Thus, a particularly excellent aesthetic appearance can be imparted to the timepiece dial 1. Specifically, in the configuration shown in FIG. 2, the triangles are equilateral triangles. Thus, a more particularly excellent aesthetic appearance can be imparted to the timepiece dial 1. Also, by adjusting the relative angle between the microlens layer 11 and the decorative layer 12 in the decorative formation process which will be described later, the adjustment of the appearance of the timepiece dial 1 can be more advantageously processed.

Also, in the configuration shown in FIG. 3, the plurality of microlenses 111 are arranged such that, in a case where the centers of microlenses 111 that are adjacent when the timepiece dial 1 is viewed from above are connected by a straight line, a plurality of quadrangles are arranged in an orderly fashion by the straight line. Thus, a particularly excellent aesthetic appearance can be imparted to the timepiece dial 1. Specifically, in the configuration shown in FIG. 3, the quadrangles are squares. Thus, a more particularly excellent aesthetic appearance can be imparted to the timepiece dial 1. Also, by adjusting the relative angle between the microlens layer 11 and the decorative layer 12 in the decorative formation process which will be described later, the adjustment of the appearance of the timepiece dial 1 can be more advantageously processed.

The focal distance of the microlenses 111 is preferably 100 μm or more and 1000 μm or less, and more preferably 150 μm or more and 500 μm or less. Thus, a particularly excellent aesthetic appearance can be imparted to the timepiece dial 1. Also, by adjusting the relative angle between the microlens layer 11 and the decorative layer 12 in the decorative formation process which will be described later, the adjustment of the appearance of the timepiece dial 1 can be more advantageously processed. The focal point is shown as P in the drawing.

The pitch $P_{ML}$ of the microlenses 111 (when the timepiece dial 1 is viewed from above) is preferably 50 μm or more and 500 μm or less, and more preferably 60 μm or more and 300 μm or less. Thus, a particularly excellent aesthetic appearance can be imparted to the timepiece dial 1. Also, by adjusting the relative angle between the microlens layer 11 and the decorative layer 12 in the decorative formation process which will be described later, the adjustment of the appearance of the timepiece dial 1 can be more advantageously processed. In a respective direction, when the adjacent microlenses 111 in between have different pitches, it is preferred that at least one of the directions satisfies the above conditions, and more preferably, all of the directions satisfy the above conditions. In the invention, the pitch of the microlenses refers to a distance between the centers of microlenses that are adjacent when the timepiece dial 1 is viewed from above.

The microlens layer 11 is composed of a material having optical transmission properties. In the invention, the phrase "having optical transmission properties" refers to having a property in which at least a portion of light in the visible light region (wavelength region of 380 to 780 nm) is transmitted; the transmissivity of light in the visible light region is preferably 50% or more; and more preferably, the transmissivity of light in the visible light region is 60% or more. Such light transmissivity can be obtained as follows, for example. By using white fluorescent light (FL20S-D65: a fluorescent light for examination manufactured by Toshiba Corp.) as the light source, an electric current value (x) when power is generated at 1000 lux only by a solar cell (solar battery) having the same shape as the member to be measured (or the timepiece dial) is obtained. Also, an electric current value (Y) when power is generated in the same state except that the member to be measured (or the timepiece dial) is placed on the light source side of the solar cell is obtained. Then, the ratio of Y to X ((Y/X)×100 [%]) obtained as above can be used as light transmissivity. Hereinafter, in this application, the phrase "transmissivity of light" indicates the value obtained in this condition except that there is any prior indication.

Examples of the material constituting the microlens layer 11 include various plastics materials and various glass materials, but the microlens layer 11 is preferably composed mainly of a plastic material. Plastic materials generally have excellent moldability (degree of freedom of molding), and can be advantageously used for manufacturing the timepiece dial 1 in various shapes. Also, a microlens layer 11 composed of plastic material is advantageous for reducing the manufacturing cost of the timepiece dial 1. Further, plastic materials generally have excellent light (visible light) transmissivity, and also have excellent radio wave transmissivity. Therefore, when the microlens layer 11 is composed of a plastic material, the timepiece dial 1 can be advantageously applied to a solar timepiece (a timepiece provided with a solar battery) and a radio timepiece. The focus of the description below is an example in which the microlens layer 11 is mainly composed of a plastic material. In the invention, the term "mainly" refers to a component present in the greatest amount content among the materials constituting the parts (members) under discussion. The content is not particularly limited, but is preferably 60 wt % or more, more preferably 80 wt % or more, and even more preferably 90 wt % or more of the material constituting the part (member) under discussion.

The plastic material constituting the microlens layer 11 can be any of a variety of thermoplastic resins, thermosetting resins, or the like. For example, this includes polycarbonate (PC), acrylonitrile-butadiene-styrene copolymer (ABS resin), polymethyl methacrylate (PMMA), and other acrylic resins; polyethylene (PE), polypropylene (PP), and other polyolefin resins; polyethylene terephthalate (PET) and other polyester resins; epoxy resins; urethane resins; and copolymers, blends, polymer alloys, or the like composed mainly of these. Also, one or more of these can be used in combination (e.g., blend resins, polymer alloys, laminates, and the like). Specifically, it is particularly preferred that the microlens layer 11 be mainly composed of polycarbonate. The microlenses 111 can thereby be endowed with greater transparency, the refractive index of the microlenses 111 can be made optimal, and a particularly excellent aesthetic appearance can thereby be imparted to the timepiece dial 1 overall. Also, a timepiece dial 1 having particularly excellent reliability can be obtained because the strength of the timepiece dial 1 overall can thereby be made particularly excellent, the microlenses 111 having greater dimensional precession can be obtained, and unwanted deformations of the microlenses 111 or other anomalies can be more reliably prevented. In the case that the microlens layer 11 is composed of an acrylic resin, a polyester resin, an epoxy resin, or a urethane resin, the microlenses 111 can be more advantageously formed by a printing method (in particular, a droplet discharge method such as an inkjet method).

The microlens layer 11 can include components other than plastic material. Examples of such components include plasticizers, antioxidants, colorants (including various color formers, fluorescent substances, phosphorescent substances, and the like), brighteners, and fillers. For example, when the microlens layer 11 is composed of a material that includes a colorant, color variations of the timepiece dial 1 can be increased.

The microlens layer 11 can have an essentially uniform composition in each part, or can have a different composition depending on the part.

The refractive index (absolute refractive index) of the microlens layer 11 is preferably 1.500 or more and 1.650 or less, and more preferably 1.550 or more and 1.600 or less. Thus, a particularly excellent aesthetic appearance can be imparted to the timepiece dial 1.

In the configuration shown in the drawings, the microlenses 111 are substantially spherical in shape, and are spherical lenses that form a circular shape when viewed from above, but the shape of the microlenses 111 is not particularly limited. For example, it is possible to use a shape that is barrel-shaped (substantially oval shape, elliptical shape), substantially triangular, substantially quadrangular, substantially hexagonal, or the like when viewed from above. Also, the shape and size of the microlens substrate (microlens layer) 11 is not particularly limited and is ordinarily determined based on the shape and size of the timepiece dial 1 to be manufactured. In the configuration shown in the drawings, the microlens substrate 11 is a flat plate shape, but can also be, e.g., a curved plate shape, or the like.

Also, the microlens substrate 11 can be molded using any method; examples of methods for molding the microlens substrate 11 include compression molding, extrusion molding, injection molding, photo fabrication, and the 2P method or the like. Also, the microlens substrate 11 can be, e.g., a plate-shaped member that does not have microlenses 111, whereon a liquid material containing the constituent material of the microlenses 111 is discharged by the inkjet method or another liquid discharge method to thereby form the microlenses 111. Further, the microlenses 111 can be formed using offset printing, gravure printing, or various other types of printing methods. Microlenses formed using a printing method are advantageous in that the production costs of the microlens substrate 11 can be reduced. In the invention, the shape of at least a portion of the microlenses of the microlens substrate is not required to be circular when viewed from above and can be, e.g., oval-shaped. Also, the plurality of microlenses can be independently arranged or adjacently connected.

Decorative Layer Formation Process

In the decorative layer formation process, the decorative layer is arranged so as to superimpose the microlens layer 11 and the decorative layer 12 when the microlens layer 11 is viewed from above. Also, the constituent units of the repeating design 121 constituting the decorative layer 12 have an arrangement, which is the same sort of the arrangement as the microlenses 111, compressed or expanded in an in-plane predetermined direction of the decorative layer 12.

Therefore, in the manufactured timepiece dial 1, it is possible to provide a timepiece dial that makes use of visual optical interference (moiré) and presents an appearance having a rich stereoscopic effect. In particular, it is possible to provide a timepiece dial that can be discerned by an observer, through sensory misperception, to have a thickness that is equal to or greater than the real thickness of the timepiece dial. Also, in this process, it is possible to efficiently manufacture plural types of timepiece dials that present a different appearance by adjusting the relative angle between the microlens layer 11 and the decorative layer 12.

The constituent units of the repeating design 121 have an arrangement, which is the same sort of the arrangement as the microlenses 111, compressed or expanded in an in-plane predetermined direction of the decorative layer 12. For example, as shown in FIG. 2, the plurality of microlenses 111 are arranged such that, in a case where the centers of microlenses 111 that are adjacent are connected by a straight line, a plurality of equilateral triangles are arranged in an orderly fashion by the straight line. In this case, in the decorative layer 12 as shown in FIG. 4, when the centers of the repeating design 121 that are adjacent are connected by a straight line, a plurality of isosceles triangles, which are not equilateral triangles, can be arranged in an orderly fashion by the straight line. In other words, the arrangement of the isosceles triangles as shown in FIG. 4 is the arrangement of the equilateral triangles compressed in a lateral direction of FIG. 2, or is the arrangement of the equilateral triangles expanded in a longitudinal direction of FIG. 2. Thus, a more particularly excellent aesthetic appearance can be imparted to the timepiece dial 1. Also, by adjusting the relative angle between the microlens layer 11 and the decorative layer 12, the adjustment of the appearance of the timepiece dial 1 can be more advantageously processed.

Also, for example, as shown in FIG. 3, the plurality of microlenses 111 in the microlens substrate 11 are arranged such that, in a case where the centers of microlenses 111 that are adjacent are connected by a straight line, a plurality of squares are arranged in an orderly fashion by the straight line. In this case, in the decorative layer 12 as shown in FIG. 5, when the centers of the repeating design 121 that are adjacent are connected by a straight line, a plurality of rectangles, which are not squares, can be arranged in an orderly fashion by the straight line. In other words, the arrangement of the rectangles as shown in FIG. 5 is the arrangement of the squares compressed in a lateral direction of FIG. 3, or is the arrangement of the squares expanded in a longitudinal direction of FIG. 3. Thus, a more particularly excellent aesthetic appearance can be imparted to the timepiece dial 1. Also, by adjusting the relative angle between the microlens layer 11 and the decorative layer 12, the adjustment of the appearance of the timepiece dial 1 can be more advantageously processed.

Regarding the constituent units of the repeating design 121, the degree of the stretching in a predetermined direction for the microlens 111 is preferably −10% or more and +10% or less, and more preferably, −5% or more and +5% less. Thus, a more particularly excellent aesthetic appearance can be imparted to the timepiece dial 1. Also, by adjusting the relative angle between the microlens layer 11 and the decorative layer 12, the adjustment of the appearance of the timepiece dial 1 can be more advantageously processed. When the degree of the stretching described above is the negative value, the constituent units of the repeating design 121 have an arrangement, which is the same sort of the arrangement as the microlenses 111, compressed in an in-plane predetermined direction of the decorative layer 12. When the degree of the stretching described above is the positive value, the constituent units of the repeating design 121 have an arrangement, which is the same sort of the arrangement as the microlenses 111, expanded in an in-plane predetermined direction of the decorative layer 12.

The in-plane predetermined direction is not particularly limited if it is in the in-plane direction of the decorative layer 12. However, in the microlens substrate 11, in a case where the centers of microlenses 111 that are adjacent are connected by a straight line, a plurality of polygons are arranged in an orderly fashion by the straight line. In this case, it is preferable that at least one of the sides configuring the polygons is in a parallel direction or a perpendicular direction. Thus, a more particularly excellent aesthetic appearance can be imparted to the timepiece dial 1. Also, by adjusting the relative angle between the microlens layer 11 and the decorative layer 12, the adjustment of the appearance of the timepiece dial 1 can be more advantageously processed.

Regarding the adjustment of the appearance of the timepiece dial by adjusting the relative angle between the microlens layer and the decorative layer, the detailed explanation is discussed below with concrete examples. In the explanation below, as shown in FIG. 3, the plurality of microlenses 111 in the microlens substrate 11 are arranged such that, in a case where the centers of microlenses 111 that are adjacent are connected by a straight line, a plurality of squares are arranged in an orderly fashion by the straight line. In addition, in the decorative layer 12 as shown in FIG. 5, when the centers of the repeating design 121 that are adjacent are connected by a straight line, a plurality of rectangles instead of squares can be arranged in an orderly fashion by the straight line. This case is explained as a representative example.

Figure 6:
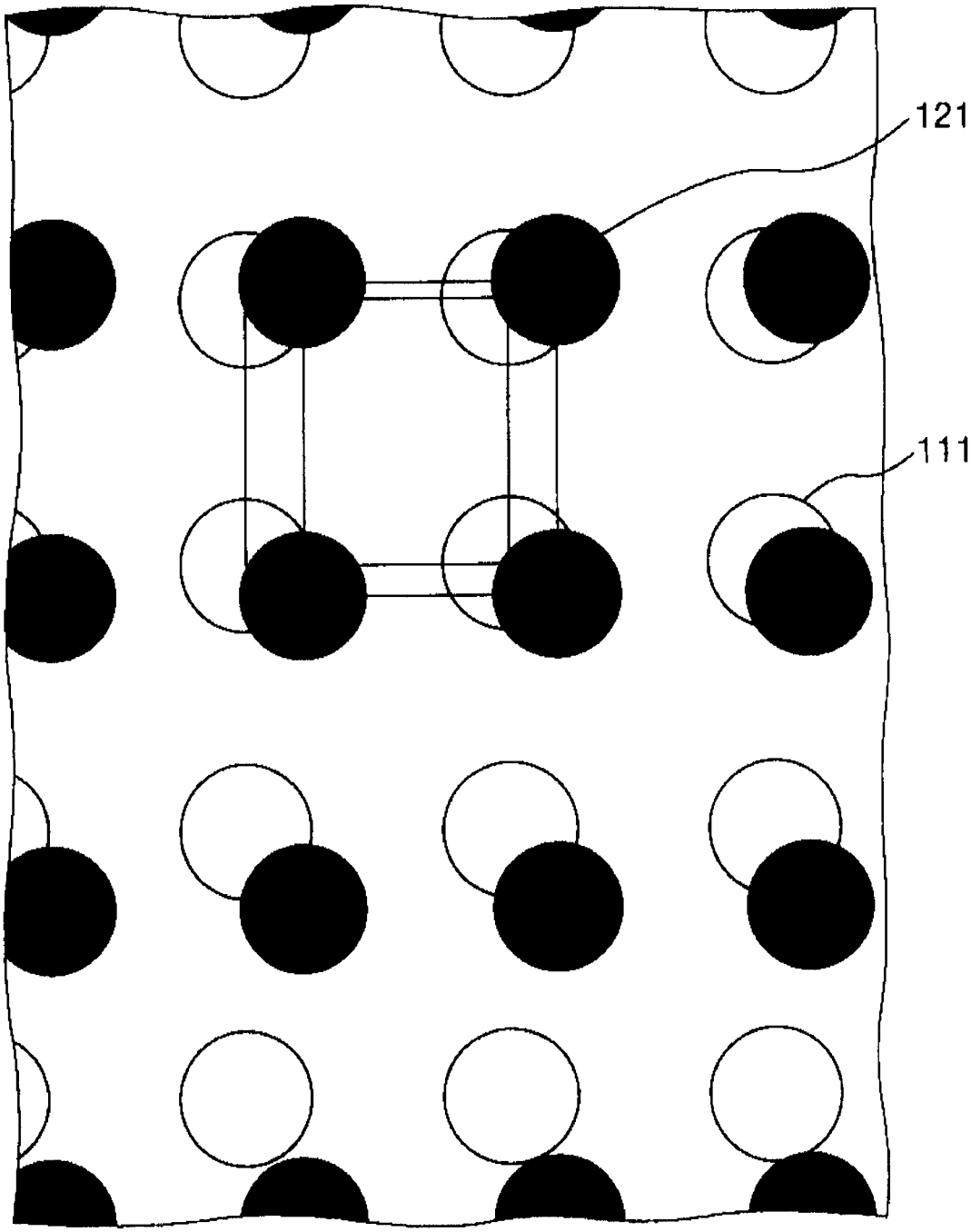
FIG. 6 is a plan view explaining a relative angle between the microlenses constituting the microlens layer and the repeating design constituting the decorative layer.
Figure 7:
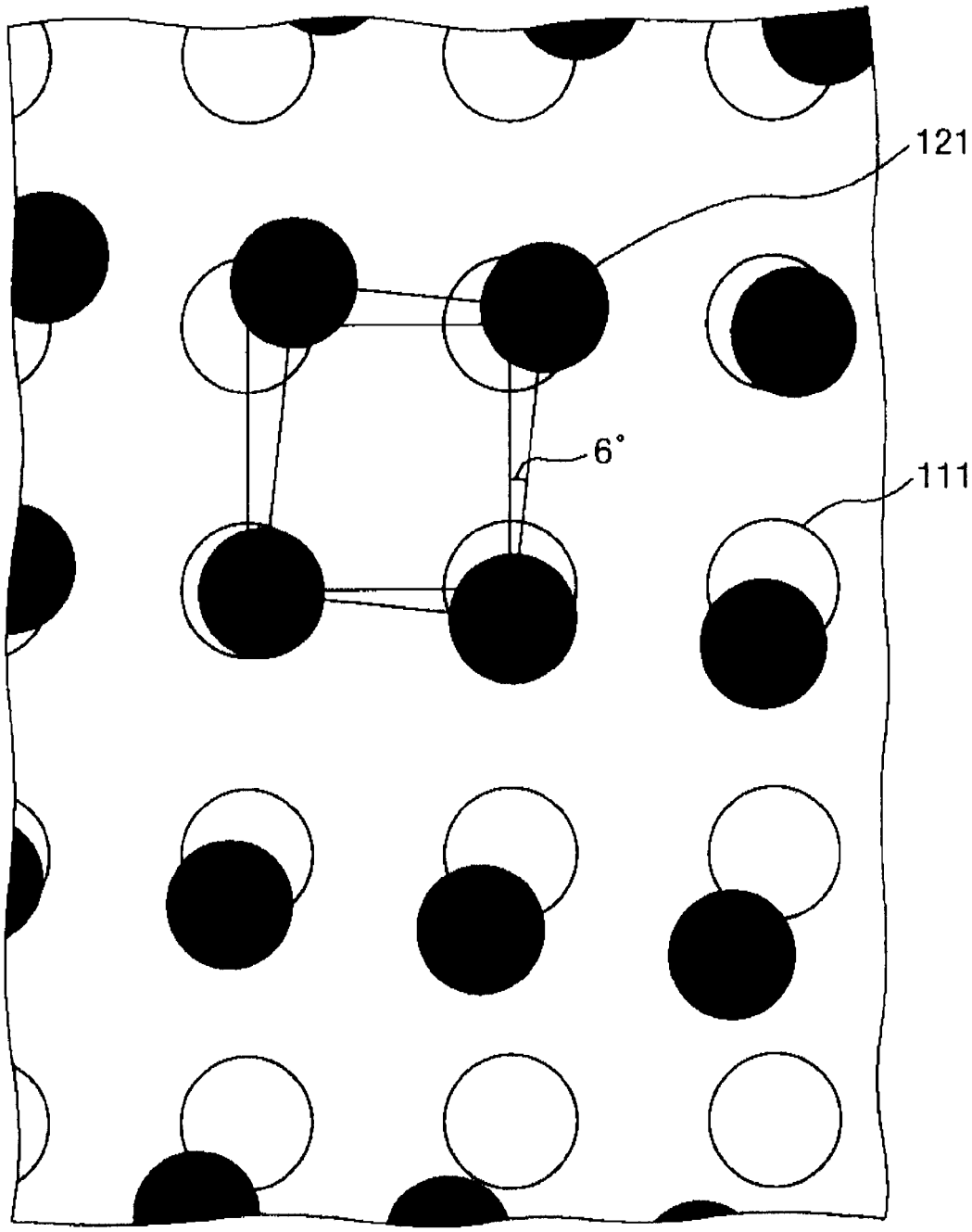
FIG. 7 is a plan view explaining a relative angle between the microlenses constituting the microlens layer and the repeating design constituting the decorative layer.
Figure 8:
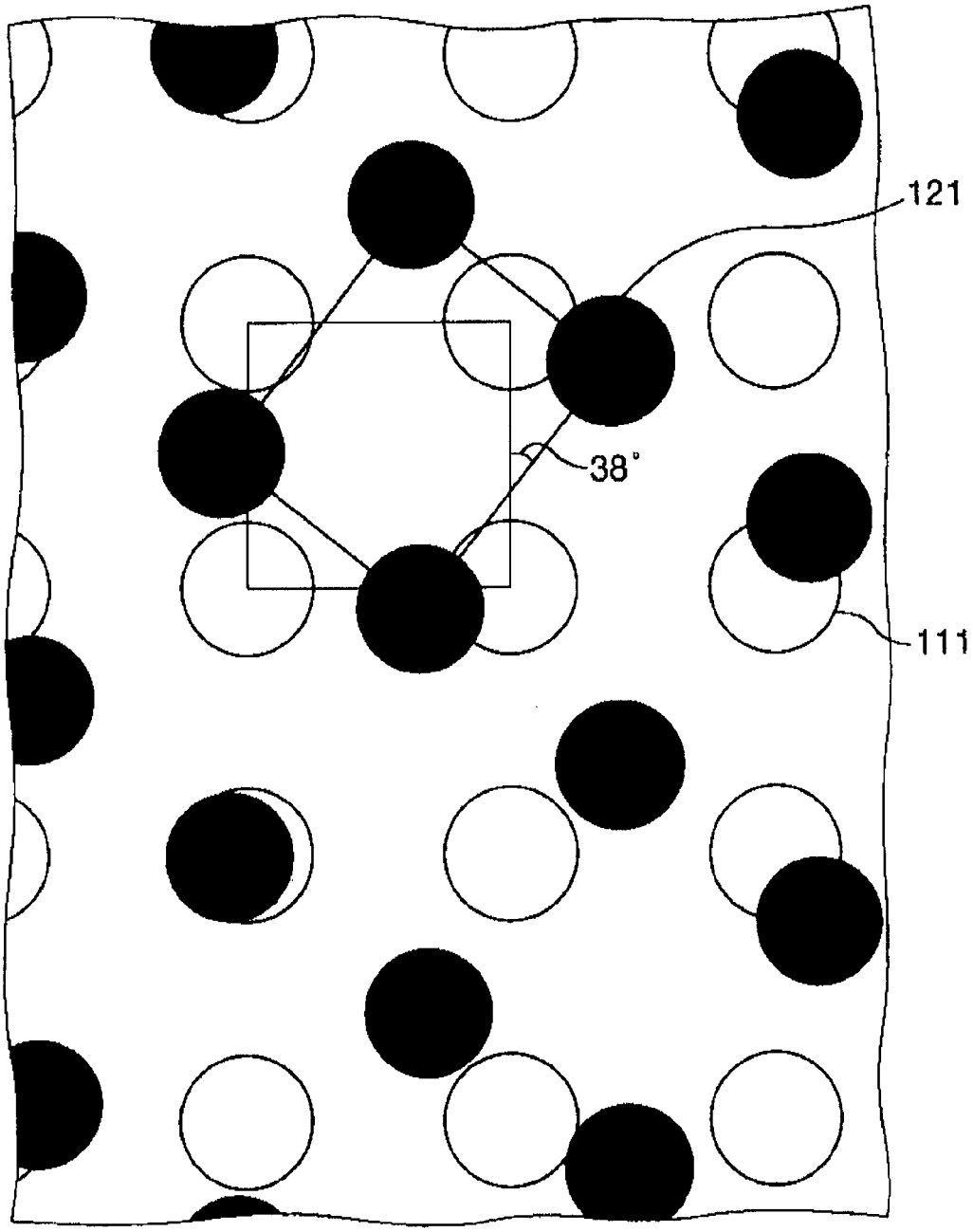
FIG. 8 is a plan view explaining a relative angle between the microlenses constituting the microlens layer and the repeating design constituting the decorative layer.

FIGS. 6 to 8 are the plan view to explain the relative angle between the microlenses constituting the microlens layer and the repeating design constituting the decorative layer. In particular, FIG. 6 shows the adjusted condition of the relative angle between the microlenses layer and the decorative layer so that two sides of the squares presented in the arrangement of the microlens are parallel to the longer sides of the rectangles presented in the arrangement of the repeating design of the decorative layer. FIG. 7 shows the adjusted condition of the relative angle between the microlens layer and the decorative layer so as to become 6° in the angle between the two sides of the squares presented in the arrangement of the microlens and the longer sides of the rectangles presented in the arrangement of the repeating design of the decorative layer. Thus, to compare with the condition shown in FIG. 6, this is a condition that the decorative layer is rotated to 6° in a right hand turn (clockwise). FIG. 8 shows the adjusted condition of the relative angle between the microlens layer and the decorative layer so as to become 38° in the angle between the two sides of the squares presented in the arrangement of the microlens and the longer sides of the rectangles presented in the arrangement of the repeating design of the decorative layer. Thus, to compare with the condition shown in FIG. 6, this is a condition that the decorative layer is rotated to 38° in a right hand turn (clockwise).

Figure 9:
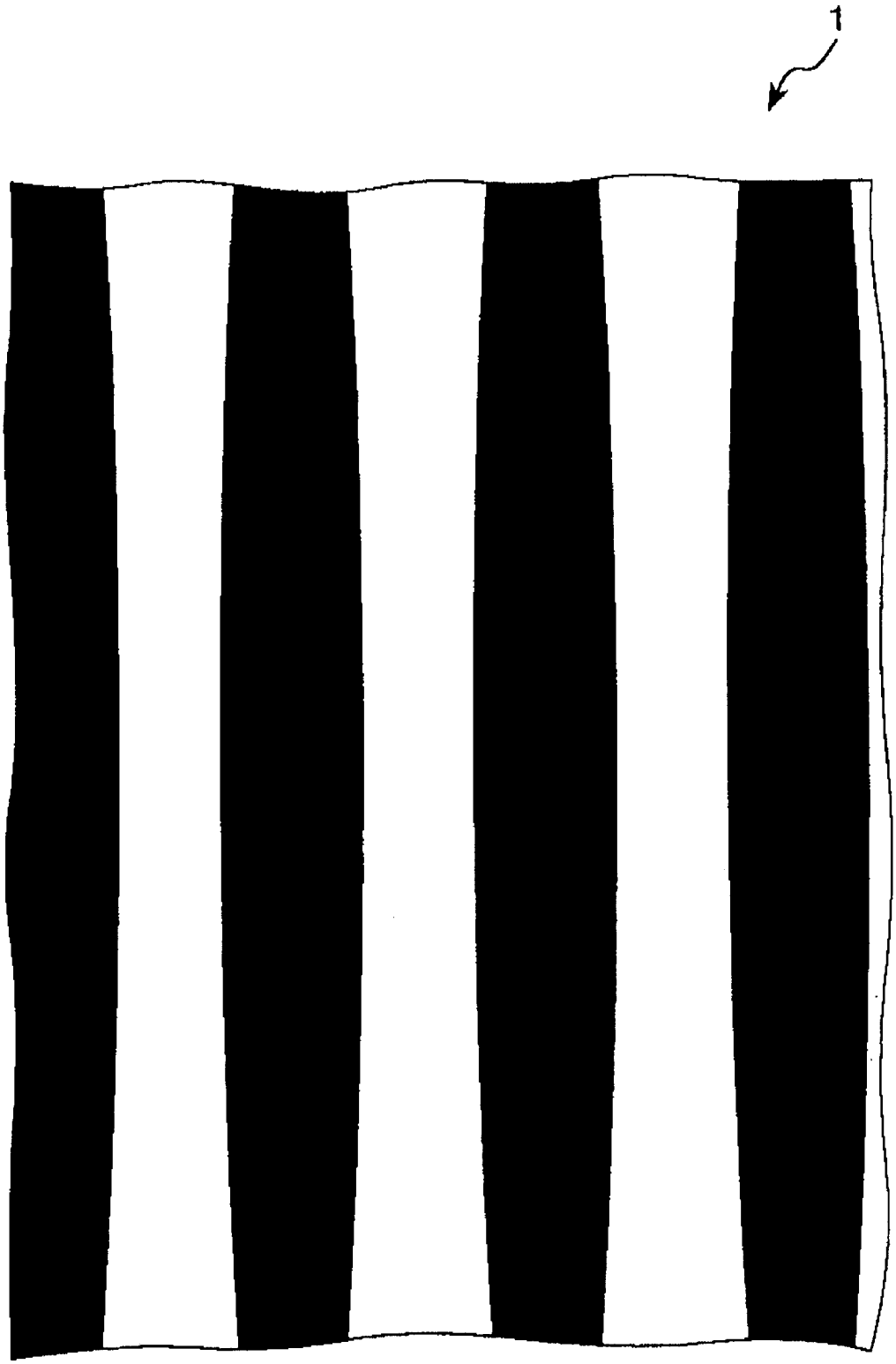
FIG. 9 is a plan view showing an appearance of the timepiece dial to show the changes of the appearance of the timepiece dial by adjusting the relative angle between the microlenses constituting the microlens layer and the repeating design constituting the decorative layer, and specifically.
Figure 10:
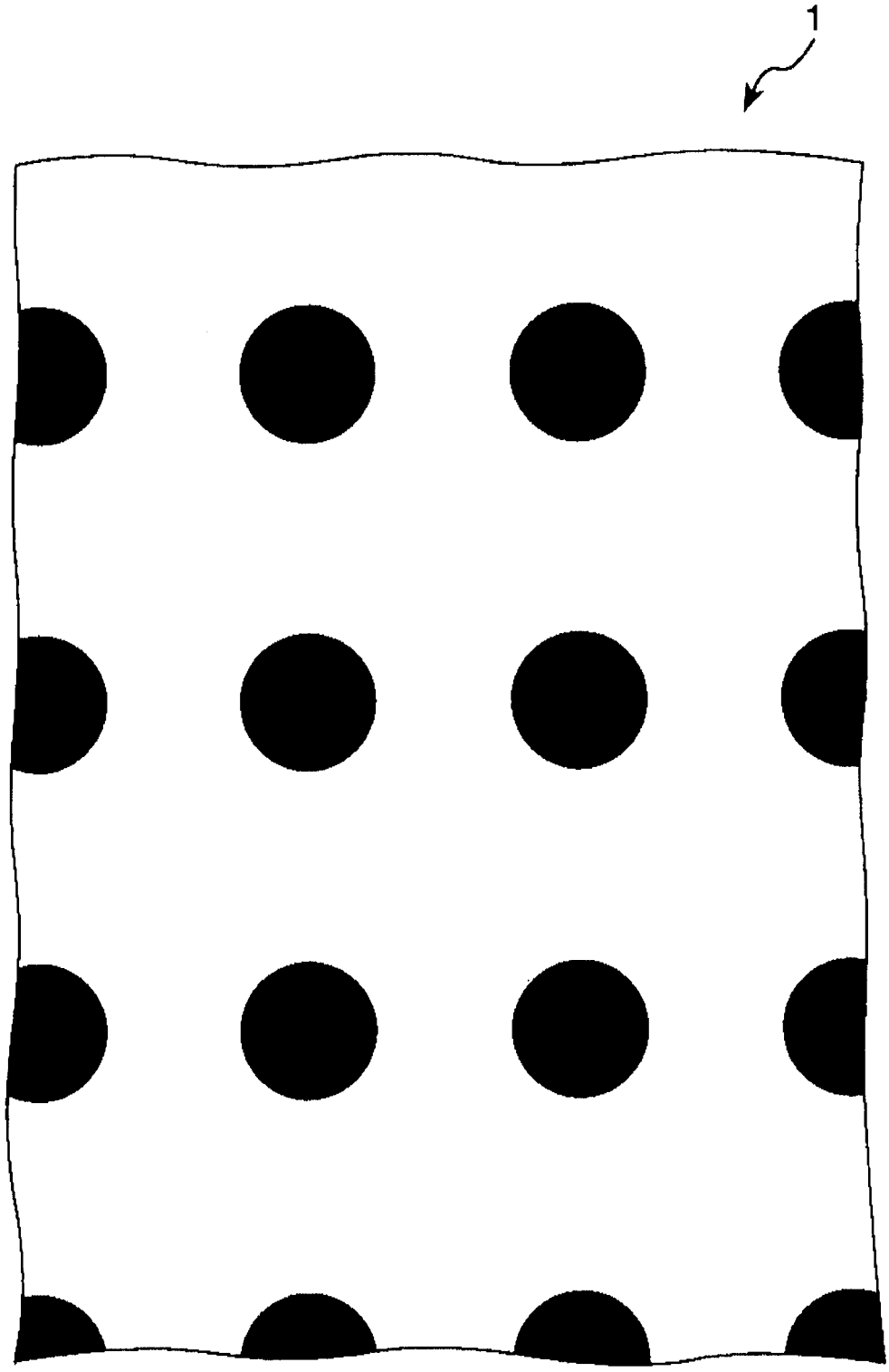
FIG. 10 is a plan view showing an appearance of the timepiece dial to show the changes of the appearance of the timepiece dial by adjusting the relative angle between the microlenses constituting the microlens layer and the repeating design constituting the decorative layer, and specifically.
Figure 11:
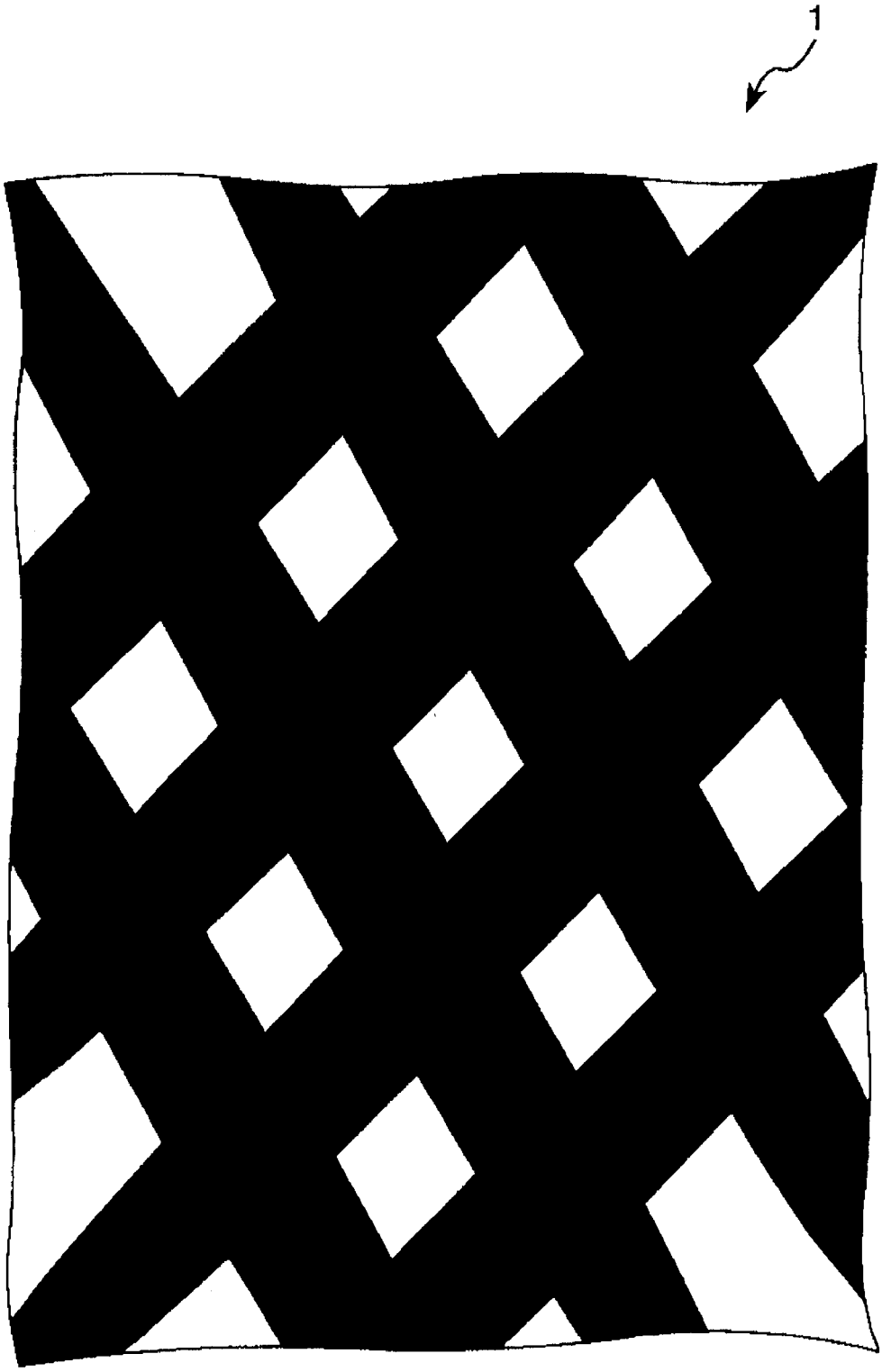
FIG. 11 is a plan view showing an appearance of the timepiece dial to show the changes of the appearance of the timepiece dial by adjusting the relative angle between the microlenses constituting the microlens layer and the repeating design constituting the decorative layer, and specifically.

FIGS. 9 to 11 are the plan view showing the changes of the appearance of the timepiece dial by adjusting the relative angle between the microlenses constituting the microlens layer and the repeating design constituting the decorative layer. In particular, FIG. 9 is the plan view showing the appearance of the timepiece dial in case of the arrangement as shown in FIG. 6. FIG. 10 is the plan view showing the appearance of the timepiece dial in case of the arrangement as shown in FIG. 7. FIG. 11 is the plan view showing the appearance of the timepiece dial in case of the arrangement as shown in FIG. 8. Also, FIGS. 9 to 11 show a frame format of the appearance when the length is 180 μm on a side of the squares; the length is 184 μm on a longer side of the rectangles; and the length is 181 μm on a shorter side of the rectangles.

As shown in FIG. 6, when the two sides of the squares are parallel to the longer sides of the rectangles by adjusting the relative angle between the microlens layer and the decorative layer, the appearance of the timepiece dial has a design with a plurality of lines, which are parallel to each other respectively, or a design with oval shape (elliptical shape) as shown in FIG. 9. On the other hand, as shown in FIG. 7, to compare with the condition shown in FIG. 6, when the decorative layer is rotated to 6° in a right hand turn (clockwise), a plurality of spot shape design is appeared as shown in FIG. 10. Also, as shown in FIG. 8, to compare with the condition shown in FIG. 6, when the decorative layer is rotated to 38° in a right hand turn (clockwise), the appearance of the timepiece dial has a design with a plurality of lines, which are crossed to each other, or a design with oval shape (elliptical shape) as shown in FIG. 11. Thus, in the invention, a variety of largely different appearances can be obtained by adjusting the relative angle between the microlens layer and the decorative layer. In detail, conventionally, to manufacture plural types of timepiece dials appearing a different stereoscopic effect, it is necessary to prepare for different molding tools and therefore, there was a problem with manufacturing a variety of products. The manufacturing method of the invention can solve this type of problems.

The method for forming the decorative layer is not limited, and for example, it is possible that the decorative layer (decorative substrate) having a repeating design on the substrate superimposes the microlens layer. Also, the decorative layer 12 can be directly formed on the surface 1112, which is the opposite side of the lens surface 1111 of the microlens layer 11, by using methods including screen printing, gravure printing, pad printing, an inkjet method, and various other printing methods. Thus, the adjustment of the relative angle between the microlens layer 11 and the decorative layer 12 can be easily and precisely processed, and the timepiece dial having an intended appearance can be more easily and precisely manufactured. Also, by using the printing method, the microlens layer (microlens substrate) 11 and the decorative layer 12 can be more securely in contact so that the distance between the microlenses 111 and the repeating design 121 can be more securely kept constant. Consequently, a stably excellent aesthetic appearance can be imparted to the timepiece dial 1.

Among various printing methods, an inkjet method is particularly preferable. By employing an inkjet method, the above-described effects can be exerted significantly, and a fine design can be formed appropriately. Etching treatment is carried out on a film formed on the substrate, and the remaining portion can be used as a repeating design.

The pitch of the adjacent constituent units of the repeating design 121 (the pitch when the timepiece dial 1 is viewed from above) $P_R$ is preferably 40 μm or more and 550 μm or less, and more preferably 50 μm or more and 350 μm or less. Thus, a particularly excellent aesthetic appearance can be imparted to the timepiece dial 1. Also, by adjusting the relative angle between the microlens layer 11 and the decorative layer 12, the adjustment for the appearance of the timepiece dial 1 can be processed efficiently. Also, when the pitches between the adjacent repeating design 121 are different in respective directions, it is preferred that at least one of the directions satisfies the above condition, and more preferably, all of the directions satisfy the above condition. In the invention, the pitch of the constituent units that are adjacent refers to a distance between the respective centers for the constituent units that are adjacent when the timepiece dial 1 is viewed from above.

The pitch $P_{ML}$ [μm] of the microlenses 111 and the pitch $P_R$ [μm] of the constituent units of the repeating design 121 preferably satisfy the relationship of $0.5 \leq P_R/P_{ML} \leq 1.5$, and more preferably satisfy the relationship of $0.7 \leq P_R/P_{ML} \leq 1.3$. It is thus possible to provide the appearance of the timepiece dial 1 with a richer stereoscopic effect and to impart a particularly excellent aesthetic appearance to the timepiece dial 1. Also, by adjusting the relative angle between the microlens layer 11 and the decorative layer 12, the adjustment for the appearance of the timepiece dial 1 can be processed efficiently.

When the pitch of the repeating design 121 is less than the pitch of the microlenses 111, the design will appear to be recessed. On the other hand, when the pitch of the design 121 is greater than the pitch of the microlenses 111, the design will appear to be floating. The constituent units of the repeating design 121 form a circular shape in the configurations shown in the drawings but the constituent units of the repeating design 121 can form any shape. For example, it can form polygonal shapes, oval shapes, star shapes, alphabetic characters or the like, cartoon characters and other more complex shapes.

The repeating design 121 can be composed of any material, examples of which include various pigments, colorants of various dyes, and materials containing a metal material. Also, the repeating design 121 can be composed of a material containing a resin material. It is thus possible to cause the repeating design 121 to have particularly exceptional adhesion to the microlens substrate 11.

The distance from the lens surface 1111 of the microlenses 111 to the surface of the decorative layer 12 (the upper-side surface in FIG. 2) is preferably 100 μm or more and 1000 μm or less, and more preferably 150 μm or more and 500 μm or less. It is thus possible to provide the appearance of the timepiece dial 1 with a richer stereoscopic effect and to impart a particularly excellent aesthetic appearance to the timepiece dial 1.

Specifically, in the configuration shown in FIG. 2, the plurality of microlenses 111 are arranged such that, in a case where the centers of microlenses 111 that are adjacent when the timepiece dial 1 is viewed from above are connected by a straight line, a plurality of triangles are arranged in an orderly fashion by the straight line. In this arrangement of the plurality of the microlenses 111, the distance from the lens surface 1111 of the microlenses 111 to the surface of the decorative layer 12 (the upper-side surface in FIG. 2) is preferably 150 μm or more and 500 μm or less, and more preferably 150 μm or more and 300 μm or less. It is thus possible to provide the appearance of the timepiece dial 1 with a richer stereoscopic effect and to impart a particularly excellent aesthetic appearance to the timepiece dial 1. Also, by adjusting the relative angle between the microlens layer 11 and the decorative layer 12, the adjustment for the appearance of the timepiece dial 1 can be processed efficiently.

Also, in the configuration shown in FIG. 3, the plurality of microlenses 111 are arranged such that, in a case where the centers of microlenses 111 that are adjacent when the timepiece dial 1 is viewed from above are connected by a straight line, a plurality of quadrangles are arranged in an orderly fashion by the straight line. In this arrangement of the plurality of the microlenses 111, the distance from the lens surface 1111 of the microlenses 111 to the surface of the decorative layer 12 (the upper-side surface in FIG. 2) is preferably 100 μm or more and 1000 μm or less, and more preferably 250 μm or more and 600 μm or less. It is thus possible to provide the appearance of the timepiece dial 1 with a richer stereoscopic effect and to impart a particularly excellent aesthetic appearance to the timepiece dial 1. Also, by adjusting the relative angle between the microlens layer 11 and the decorative layer 12, the adjustment for the appearance of the timepiece dial 1 can be processed efficiently.

The focal distance $L_0$ [μm] of the microlenses 111 and the distance $L_1$ [μm] from the lens surface 1111 of the microlenses 111 to the surface of the decorative layer 12 preferably satisfy the relationship of $0.5 \leq L_1/L_0 \leq 1.5$, and more preferably satisfy the relationship of $0.6 \leq L_1/L_0 \leq 1.4$. It is thus possible to provide the appearance of the timepiece dial 1 with a richer stereoscopic effect and to impart a particularly excellent aesthetic appearance to the timepiece dial 1. Also, by adjusting the relative angle between the microlens layer 11 and the decorative layer 12, the adjustment for the appearance of the timepiece dial 1 can be processed efficiently.

In the timepiece dial 1, the repeating design 121 and microlenses 111 are provided in at least a portion where the time characters are not provided when the timepiece dial 1 is viewed from above. In a portion where the time characters are provided, it is preferable not to provide the repeating design 121 and/or the microlenses 111. It is thus possible to impart a particularly excellent time visibility as well as an excellent aesthetic appearance of the timepiece dial 1, and it is possible to achieve a higher level of both practicality as a commercial product and an aesthetic appearance as a decoration.

Timepiece Dial

The timepiece dial of the invention is provided by using the above discussed methods. The timepiece dial of the invention has the microlens layer composed of a plurality of microlenses 111 arranged in an orderly fashion when viewed from above, and the decorative layer composed of the repeating design having a plurality of constituent units. The microlens layer and the decorative layer are superimposed when the microlens layer is viewed from above. This timepiece dial has the appearance with a richer stereoscopic effect. More detailed explanation, the timepiece dial 1 of the invention uses visual optical interference (moiré) and presents an appearance having a rich stereoscopic effect. In particular, it is possible to provide a timepiece dial that can be discerned by an observer, through sensory misperception, to have a thickness that is equal to or greater than the real thickness of the timepiece dial. In the timepiece dial, the microlens layer is formed closer to the observer side (outer surface side) than the decorative layer.

The timepiece dial is preferably applied to a portable timepiece (e.g., a wristwatch). Portable timepieces are timepieces having a particular requirement for thinness, and in accordance with the invention, the stereoscopic effect of the timepiece dial can be made sufficiently excellent while the timepiece dial is made sufficiently thin. In other words, the effects of the invention can be more dramatically demonstrated in a case where the timepiece dial of the invention is applied to a portable timepiece.

Also, the above described methods used for manufacturing the timepiece dial of the invention are not limited and it is also possible to use other methods if it satisfies the condition below. In particular, the timepiece dial of the invention has the microlens layer composed of a plurality of microlenses 111 arranged in an orderly fashion when viewed from above, and the decorative layer composed of regions where the constituent units that are adjacent have different pitches with respect to one another. The microlens layer and the decorative layer can be superimposed when viewed from above. It is thus possible to impart an excellent aesthetic appearance of the timepiece dial.

Figure 12:
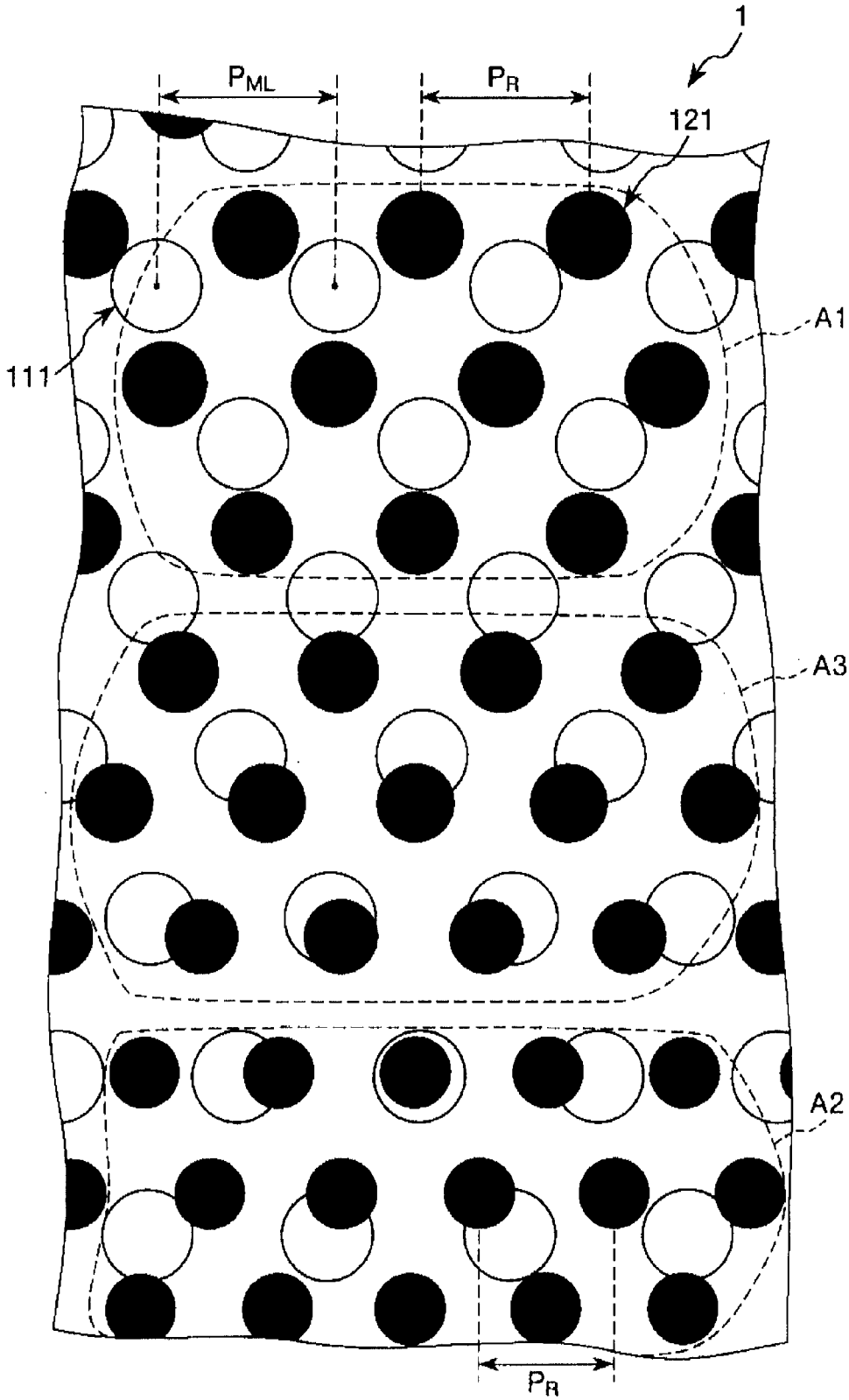
FIG. 12 is a plan view (a plan view explaining an arrangement relationship between the microlenses constituting the microlens layer and the repeating design constituting the decorative layer) showing a preferred embodiment of the timepiece dial of the invention.
Figure 13:
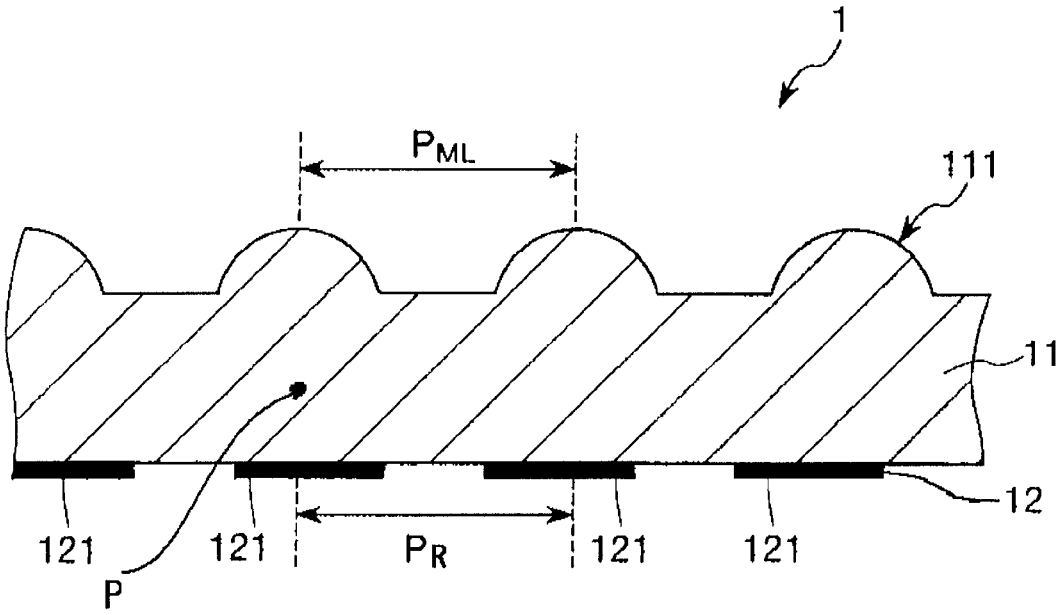
FIG. 13 shows a cross-sectional view of the timepiece dial as shown in FIG. 12.

FIG. 12 is a plan view (a plan view explaining an arrangement relationship between the microlenses constituting the microlens layer and the repeating design constituting the decorative layer) showing a preferred embodiment of the timepiece dial of the invention; FIG. 13 shows a cross-sectional view of the timepiece dial as shown in FIG. 12. In FIG. 12 (similar to FIG. 14 discussed later), the upper side indicates the central part side of the timepiece dial, and the lower side indicates the circumference side of the timepiece dial. Hereinafter, regarding the timepiece dial of the present embodiment, the points which are different from the previously described embodiments are focused in the explanation, and the points which are the same as the previously described embodiments are omitted in the explanation.

As shown in the drawings, the timepiece dial of the present embodiment includes the microlens layer 11 and the decorative layer 12. The microlens layer 11 includes a plurality of microlenses 111 arranged in an orderly fashion when the timepiece dial 1 (microlens layer 11) is viewed from above. The decorative layer 12 includes the repeating design 121 having a plurality of constituent units. When the timepiece dial is viewed from above, the microlens layer 11 and the decorative layer 12 are superimposed. Also, in the present embodiment, the decorative layer 12 has regions having different pitches between the constituent units (constituent units of the repeating design 121) that are adjacent with respect to one another. In detail, the first region A1 has a pitch between the constituent units that are adjacent, and the second region A2 has a pitch which is different from the pitch in the first region A1.

By configuring the timepiece dial in this manner, it is possible to provide a timepiece dial that makes use of visual optical interference (moiré) and presents an appearance having a rich stereoscopic effect. In particular, as a result of thoroughgoing research, the present inventors found that it is possible to provide a timepiece dial that can be discerned by an observer, through sensory misperception, to have a thickness that is equal to or greater than the real thickness of the timepiece dial. Also, the decorative layer has regions having pitches of the adjacent constituent units that are different from each other. It is thus possible to cause an observer to discern that the timepiece dial has regions of a different depth and the stereoscopic effect of the timepiece dial is extremely excellent.

Also, in the present embodiment, the constituent units of the repeating design 121 has the similar arrangement as the microlenses 111 and/or the arrangement compressed or expanded in an in-plane predetermined direction of the decorative layer 12. It is thus possible to impart an excellent aesthetic appearance of the timepiece dial.

In the present embodiment, $P_{ML}$ [μm] is the pitch of the microlenses 111 and $P_R$ [μm] is the pitch of the constituent units of the repeating design 121. When the timepiece dial 1 is viewed from above, the timepiece dial 1 has the third region A3 where the value of $P_{ML}-P_R$ is gradually increased from the center of the timepiece dial 1 to the circumference part. It is thus possible to cause an observer to discern the depth increased from the center of the timepiece dial 1 to the circumference part (for example, a dome-shaped timepiece dial can be discerned).

As discussed above, the pitch of the adjacent constituent units of the repeating design 121 (the pitch when the timepiece dial 1 is viewed from above) $P_R$ is preferably 40 μm or more and 550 μm or less, and more preferably 50 μm or more and 350 μm or less. In the timepiece dial 1 of the present embodiment, the decorative layer 12 has regions where the pitches of the adjacent constituent units are different from each other. The pitches of the adjacent constituent units are preferably in the above-described range with respect to the entire effective region (region where the microlens layer 11 and the decorative layer 12 are superimposed when the timepiece dial 1 is viewed from above). Thus, the above-described effects can be exerted significantly.

As described above, the pitch $P_{ML}$ [μm] of the microlenses 111 and the pitch $P_R$ [μm] of the constituent units of the repeating design 121 preferably satisfy the relationship of $0.5 \leq P_R/P_{ML} \leq 1.5$, and more preferably satisfy the relationship of $0.7 \leq P_R/P_{ML} \leq 1.3$. In the timepiece dial 1 of the present embodiment, the decorative layer 12 has regions where the pitches of the adjacent constituent units are different from each other. The pitch of the adjacent constituent units preferably satisfies the above relationship with respect to the entire effective region (region where the microlens layer 11 and the decorative layer 12 are superimposed when the timepiece dial 1 is viewed from above).

Also, in the present embodiment, the microlens layer (microlens substrate) 11 and the decorative layer 12 is securely in contact so that the distance between the microlenses 111 and the repeating design 121 can be more securely kept constant. Consequently, a stably excellent aesthetic appearance can be imparted to the timepiece dial 1.

The method for forming the repeating design 121 is not limited, and for example, the methods can be screen printing, gravure printing, pad printing, an inkjet method, and various other printing methods. Thus, the microlens layer (microlens substrate) 11 and the decorative layer 12 is securely in contact so that the distance between the microlenses 111 and the repeating design 121 can be more securely kept constant. Consequently, a stably excellent aesthetic appearance can be imparted to the timepiece dial 1.

Among various printing methods, an inkjet method is particularly preferable. By employing an inkjet method, the above-described effects can be exerted significantly, and a fine design can be formed appropriately. Also, etching treatment is carried out on a film formed on the substrate, and the remaining portion can be used as a repeating design. Further, the shape and size of the decorative layer 12 is not particularly limited and is ordinarily determined based on the shape and size of the timepiece dial 1 to be manufactured. In the configuration shown in the drawings, the decorative layer 12 is a flat plate shape, but can also be, e.g., a curved plate shape, or the like.

Figure 14:
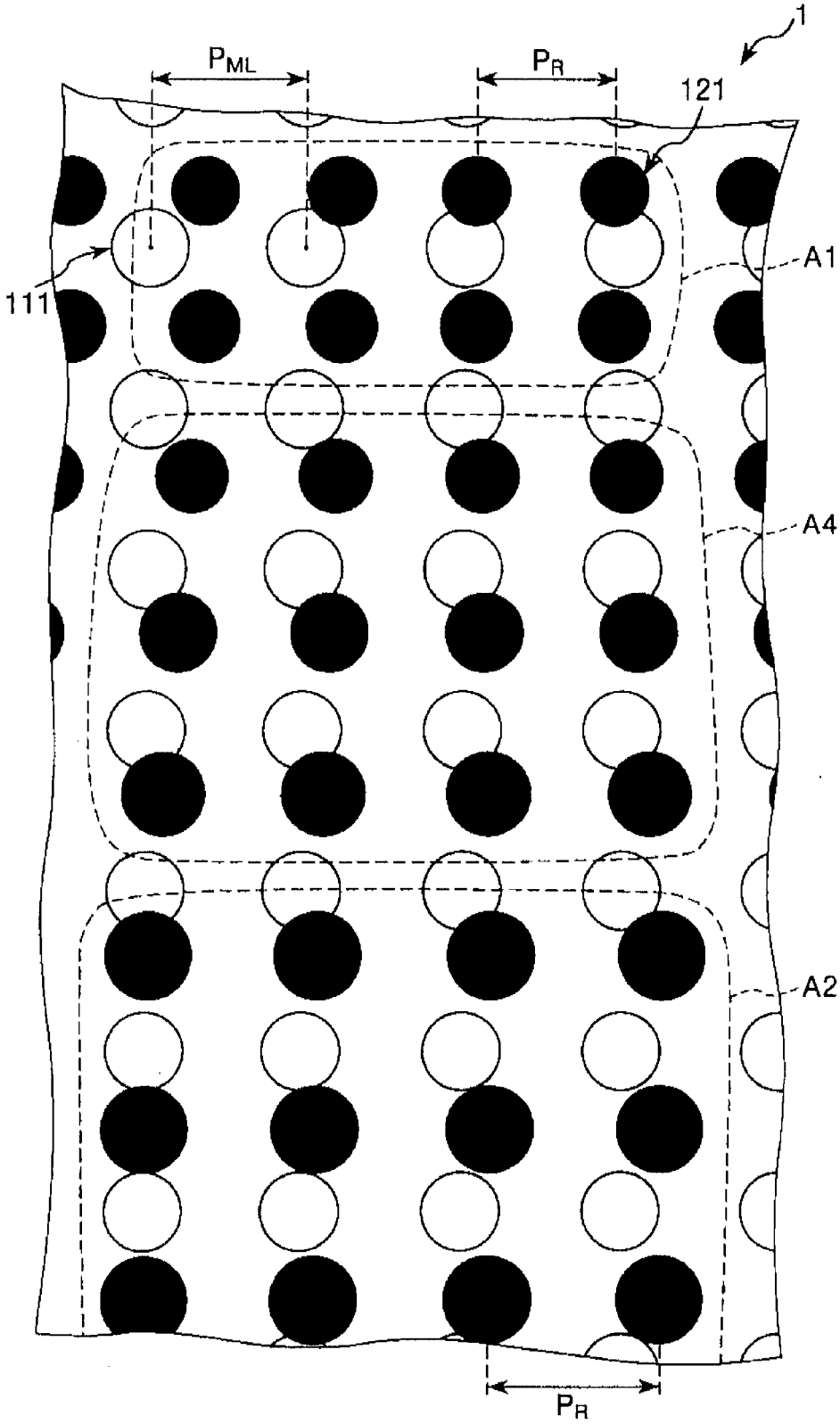
FIG. 14 is a plan view (a plan view explaining an arrangement relationship between the microlenses constituting the microlens layer and the repeating design constituting the decorative layer) showing another embodiment of the timepiece dial of the invention.

FIG. 14 is a plan view (a plan view explaining an arrangement relationship between the microlenses constituting the microlens layer and the repeating design constituting the decorative layer) showing another embodiment of the timepiece dial of the invention. Hereafter, regarding the timepiece dial of the present embodiment, the points which are different from the previously described embodiments are focused in the explanation, and the points which are the same as the previously described embodiments are omitted in the explanation. In the timepiece dial 1 of the present embodiment, in a case where the centers of adjacent microlenses 111 when the timepiece dial is viewed from above are connected by a straight line, a plurality of squares are arranged in an orderly fashion by the straight line. In a case where the centers of the adjacent repeating design 121 when the timepiece dial is viewed from above are connected by a straight line, a plurality of trapezoids can be arranged in an orderly fashion by the straight line. As described above, in the present embodiment, the arrangement pattern of the microlenses and the repeating design is not limited as explained in the previously described embodiments. The arrangement pattern can be as described in the present embodiment so that the above-described same effects can be exerted. Also, in the arrangement pattern as described in the present embodiment, an excellent aesthetic appearance can be imparted to the timepiece dial 1.

In the present embodiment, $P_{ML}$ [μm] is the pitch of the microlenses 111 and $P_R$ [μm] is the pitch of the constituent units of the repeating design 121. When the timepiece dial 1 is viewed from above, the timepiece dial 1 has the fourth region A4 where the value of $P_{ML}-P_R$ is gradually reduced from the center of the timepiece dial 1 to the circumference part. It is thus possible to cause an observer to discern the depth increased from the circumference part to the center of the timepiece dial 1 (for example, a mortar-shaped timepiece dial can be discerned).

Timepiece

Next, the timepiece of the invention provided with the timepiece dial of the invention described above is explained. The timepiece of the invention has the timepiece dial of the invention described above. As described above, the timepiece dial of the invention presents an appearance with rich stereoscopic effect. Specifically, the timepiece dial of the invention is capable of being discerned by an observer, through sensory misperception, to have a thickness that is equal to or greater than the real thickness of the timepiece dial. The timepiece dial of the invention has excellent decorative characteristics (an excellent aesthetic appearance). Also, excellent optical transmission properties can be imparted to the overall timepiece dial 1 while an excellent appearance such as that described above can be ensured by the selection of the materials of the decorative layer 12, and the like. Accordingly, the timepiece of the invention provided with such a timepiece dial can sufficiently satisfy the requirements of a solar timepiece. It is possible to use known components other than the timepiece dial constituting the timepiece of the invention (the timepiece dial of the invention). An example of the configuration of the timepiece of the invention is described below.

Figure 15:
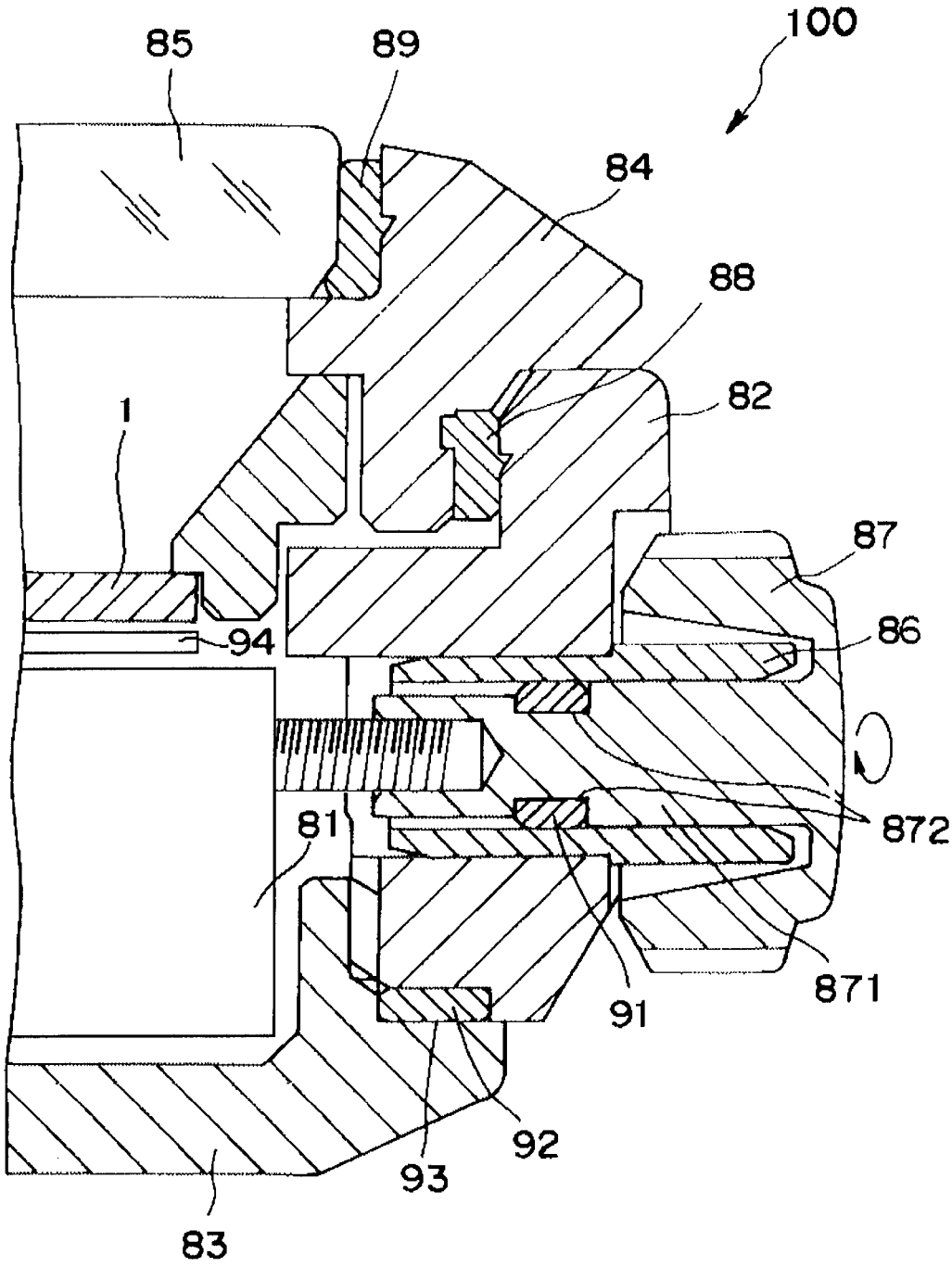
FIG. 15 is a part of the cross-sectional view showing the preferred embodiment of the timepiece (portable timepiece) of the invention.

FIG. 15 is a cross-sectional view of a preferred embodiment of the timepiece (wristwatch) of the invention. The wristwatch (portable timepiece) 100 of the present embodiment is provided with a case body (case) 82, a case back 83, a bezel (edge) 84, and a glass plate (cover glass) 85, as shown in FIG. 15. Also, inside of the case 82 includes the timepiece dial 1 of the invention as described above, a solar battery 94, a movement 81, and index (indicator; not shown) and the like. The timepiece dial 1 is provided between the solar battery 94 and the glass plate (cover glass) 85, and the microlens substrate 11 is arranged so as to face the glass plate (cover glass) 85 side.

The glass plate 85 is ordinarily composed of transparent glass, sapphire, or the like having high transparency. The aesthetic properties of the timepiece dial 1 of the invention can thereby be sufficiently demonstrated, and a sufficient amount of light can be allowed to be incident on the solar battery 94. The movement 81 drives the index using the electromotive force of the solar battery 94. Although not shown in FIG. 15, there are provided inside the movement 81, e.g., an electric double layer capacitor for storing the electromotive force of the solar battery 94, a lithium-ion secondary battery, a crystal oscillator as a time reference source, a semiconductor integrated circuit for generating a drive pulse for driving the timepiece on the basis of the oscillating frequency of the crystal oscillator, a step motor for driving the index in one-second increments on the basis of the drive pulse, a train wheel mechanism for transmitting the movement of the step motor to the index, and other components.

Also, the movement 81 is provided with an antenna (not shown) for receiving radio waves, and has a function for performing time adjustment or the like using the received radio waves. The solar battery 94 has a function for converting light energy into electric energy. The electric energy converted by the solar battery 94 is used for driving the movement and for other purposes. The solar battery 94 has, e.g., a p-i-n structure in which a p-type impurity and an n-type impurity are selectively introduced into non-single crystal silicon thin films, and an i-type non-single crystal silicon thin film having a low impurity concentration is provided between the p-type non-single crystal silicon thin film and the n-type non-single crystal silicon thin film.

A stem pipe 86 is fitted into and secured to the case 82, and a shaft part 871 of a crown 87 is rotatably inserted into the stem pipe 86. The case 82 and bezel 84 are secured by a plastic gasket 88, and the bezel 84 and glass plate 85 are secured by a plastic gasket 89. Also, the case back 83 is fitted (or threaded) onto the case 82, and a ring-shaped rubber gasket (case back gasket) 92 is intermediately inserted in a compressed state into these joining parts (seal parts) 93. This configuration fluid-tightly seals the joining parts, and a waterproof function is obtained.

A groove 872 is formed in the outer periphery of the crown 87 at a midway point of the shaft part 871, and a ring-shaped rubber gasket (crown gasket) 91 is fitted into the groove 872. The rubber gasket 91 is in close contact with the internal peripheral surface of the stem pipe 86, and is compressed between the internal peripheral surface and the inner surface of the groove 872. This configuration fluid-tightly seals the crown 87 and the stem pipe 86, and a waterproof function is obtained. When the crown 87 is rotatably operated, the rubber gasket 91 rotates together with the shaft part 871, and slides in the peripheral direction while in close contact with the internal peripheral surface of the stem pipe 86.

Among various types of timepieces, a watch (wristwatch) such as that described above particularly needs to be made thinner. Therefore, the invention can be more advantageously applied in that the timepiece dial is made thinner and an excellent aesthetic appearance is obtained. In the description above, a wristwatch (portable timepiece) as a solar radio wave timepiece was described as an example of a timepiece, but the invention can also be similarly applied to portable timepieces other than a wristwatch, a fixed timepiece, a wall timepiece, and various other types of timepieces. Also, the invention can be applied to solar timepieces excluding solar radio wave timepieces, radio wave timepieces excluding solar radio wave timepieces, and any other timepiece. Preferred embodiments of the invention are described above, but the invention is not limited to the description above.

For example, it is possible to have another process in addition to the above described processes in the manufacturing method of the timepiece dial of the invention. Also, in the invention, the combination of the arrangement pattern of the microlenses in the microlens layer and the arrangement pattern of the repeating design in the decorative layer is not limited to the examples in the embodiments as described above.

Also, with the timepiece dial and the timepiece of the invention, the configuration of each part can be substituted with any configuration that demonstrates the same function, and any configuration can be added. For example, at least one layer can be provided to the surface of the microlens layer and/or the decorative layer. Such a layer can be removed when, e.g., the timepiece dial enters service or at another time.

Also, in the embodiments described above, the microlenses were provided on the microlens layer with the same pattern, and however, it is possible to have a plurality of the regions where the arrangement pattern of the microlenses is different. Also, it is possible to have the decorative layer including a plurality of regions where the shape of the constituent units of the repeating design is different. Further, it is possible to consecutively change the pitches of the microlenses that are adjacent. In a similar manner, it is possible to consecutively change the pitches, the arrangement, or the like of the constituent units of the repeating design.

In the embodiments described above, the description was focused on the case that when the timepiece dial is viewed from above, the repeating design and/or the microlenses were not provided in the part where the time characters were provided. However, the repeating design and/or the microlenses can be provided in the part where the time characters are provided when the timepiece dial is viewed from above. In the embodiments described above, as a typical case, the microlens layer is provided with convex lenses as the microlenses, but the microlenses can be concave lenses as long as the focal points are connected on the surface side on which the decorative layer is provided. In the embodiments described above, as a typical case, the microlens layer provided with the microlenses and the decorative layer having the repeating design are in close contact, but the microlens layer and the decorative layer do not need to be in close contact. For example, the timepiece dial can have a microlens substrate and a substrate provided with a decorative layer, which are spaced apart with a predetermined distance.

What is claimed is:

1. A method for manufacturing a timepiece dial comprising:

a microlens layer preparing process for preparing a microlens layer having a first surface and a second surface being opposite to the first surface, the microlens layer including a plurality of microlenses arranged on the first surface in an orderly fashion as viewed in a planar view, the second surface being flat, the microlens layer being integrally formed as a one-piece, unitary member; and a decorative layer forming process for forming a decorative layer on the second surface of the microlens layer, the decorative layer being formed as an independent member from the microlens layer, the decorative layer including a repeating design having a plurality of constituent units in an orderly fashion, the microlens layer and the decorative layer being superimposed as viewed in the planar view, each of the constituent units of the repeating design of the decorative layer being flat;

the constituent units of the repeating design having an arrangement, which is the same arrangement as the microlenses, compressed or expanded in an in-plane predetermined direction of the decorative layer, $P_{ML}$ (μm) being a pitch of the microlenses, $P_R$ (μm) being a pitch of the constituent units of the repeating design, the timepiece dial having a region, in the planar view of the timepiece dial, a value of $P_{ML}-P_R$ being gradually increased from a center of the timepiece dial to a circumference part in the region, the constituent units of the repeating design being spaced apart from each other on the second surface of the microlens layer such that the second surface of the microlens layer exposes through a spacing defined between an adjacent pair of the constituent units of the repeating design.

2. The method for manufacturing the timepiece dial according to claim 1, wherein in a case where centers of the microlenses that are adjacent as viewed in the planar view of the timepiece dial are connected by a straight line, a plurality of equilateral triangles are arranged in an orderly fashion by the straight line, and when the timepiece dial is viewed in the planar view, straight lines connecting the centers of adjacent microlenses form a plurality of isosceles triangles, which are not equilateral triangles.

3. The method for manufacturing the timepiece dial according to claim 1, wherein in a case where centers of the microlenses that are adjacent as viewed in the planar view of the timepiece dial are connected by a straight line, a plurality of squares are arranged in an orderly fashion by the straight line, and when the timepiece dial is viewed in the planar view, straight lines connecting the centers of adjacent microlenses form a plurality of rectangles, which are not squares.

4. The method for manufacturing the timepiece dial according to claim 1, wherein a distance from lens surfaces of the microlenses to a surface of the decorative layer in the timepiece dial is 100 μm or more and 1000 μm or less.

5. The method for manufacturing the timepiece dial according to claim 1, wherein a focal distance of the microlenses is 100 μm or more and 1000 μm or less.

6. The method for manufacturing the timepiece dial according to claim 1, wherein a pitch of the microlenses is 50 μm or more and 500 μm or less.

7. The method for manufacturing the timepiece dial according to claim 1, wherein a pitch of the constituent units of the repeating design is 40 μm or more and 550 μm or less.

8. The method for manufacturing the timepiece dial according to claim 1, wherein a focal distance $L_0$ (μm) of the microlenses and a distance $L_1$ (μm) from lens surfaces of the microlenses to a surface of the decorative layer satisfy the relationship of $0.5 \leq L_1/L_0 \leq 1.5$.

9. The method for manufacturing the timepiece dial according to claim 1, wherein a pitch $P_{ML}$ (μm) of the microlenses and a pitch $P_R$ (μm) of the constituent units of the repeating design satisfy the relationship of $0.5 \leq P_R/P_{ML} \leq 1.5$.

10. The method for manufacturing the timepiece dial according to claim 1, wherein in at least a portion where time characters are not provided, the repeating design of the decorative layer and the microlenses of the microlens layer are provided as viewed in the planar view of the timepiece of dial, and in a portion where the time characters are provided, the repeating design of the decorative layer and/or the microlenses of the microlens layer are not provided.

11. A timepiece dial manufactured by using the methods according to claim 1.

12. A timepiece dial comprising:

a microlens layer having a first surface and a second surface being opposite to the first surface, the microlens layer including a plurality of microlenses arranged on the first surface in an orderly fashion as viewed in a planar view, the second surface being flat, the microlens layer being integrally formed as a one-piece, unitary member; and a decorative layer arranged on the second surface of the microlens layer, the decorative layer being formed as an independent member from the microlens layer, the decorative layer including a repeating design having a plurality of constituent units, each of the constituent units of the repeating design of the decorative layer being flat;

the microlens layer and the decorative layer being superimposed as viewed in the planar view, the decorative layer having regions where pitches of the constituent units that are adjacent are different from each other, $P_{ML}$ (μm) being a pitch of the microlenses, $P_R$ (μm) being a pitch of the constituent units of the repeating design, the timepiece dial having a region, in the planar view of the timepiece dial, a value of $P_{ML}-P_R$ being gradually increased from a center of the timepiece dial to a circumference part in the region, the constituent units of the repeating design being spaced apart from each other on the second surface of the microlens layer such that the second surface of the microlens layer exposes through a spacing defined between an adjacent pair of the constituent units of the repeating design.

13. The timepiece dial according to claim 12, wherein the constituent units of the repeating design have an arrangement which is the same arrangement as the microlenses, and/or an arrangement compressed or expanded in an in-plane predetermined direction of the decorative layer.

14. The timepiece dial according to claim 12, wherein in a case where centers of the microlenses that are adjacent as viewed in the planar view of the timepiece dial are connected by a straight line, a plurality of equilateral triangles are arranged in an orderly fashion by the straight line, and when the timepiece dial is viewed in the planar view, straight lines connecting the centers of adjacent microlenses form a plurality of equilateral triangles.

15. The timepiece dial according to claim 12, wherein in a case where centers of the microlenses that are adjacent as viewed in the planar view of the timepiece dial are connected by a straight line, a plurality of squares are arranged in an orderly fashion by the straight line, and when the timepiece is viewed in the planar view, straight lines connecting the centers of adjacent microlenses form a plurality of trapezoids.

16. The timepiece dial according to claim 12, wherein in at least a portion where time characters are not provided, the repeating design of the decorative layer and the microlenses of the microlens layer are provided as viewed in the planar view of the timepiece of dial, and in a portion where the time characters are provided, the repeating design of the decorative layer and/or the microlenses of the microlens layer are not provided.

17. A timepiece comprising the timepiece dial according to claim 12.

18. A timepiece dial comprising:

a microlens layer having a first surface and a second surface being opposite to the first surface, the microlens layer including a plurality of microlenses arranged on the first surface in an orderly fashion as viewed in a planar view, the second surface being flat, the microlens layer being integrally formed as a one-piece, unitary member; and a decorative layer arranged on the second surface of the microlens layer, the decorative layer being formed as an independent member from the microlens layer, the decorative layer including a repeating design having a plurality of constituent units, each of the constituent units of the repeating design of the decorative layer being flat;

the microlens layer and the decorative layer being superimposed as viewed in the planar view, the decorative layer has regions where pitches of the constituent units that are adjacent are different from each other $P_{ML}$ (μm) being the pitch of the microlenses, $P_R$ (μm) being the pitch of the constituent units of the repeating design, the timepiece dial having a region, as viewed in the planar view of the timepiece dial, a value of $P_{ML}-P_R$ being gradually reduced from a center of the timepiece dial to a circumference part, the constituent units of the repeating design being spaced apart from each other on the second surface of the microlens layer such that the second surface of the microlens layer exposes through a spacing defined between an adjacent pair of the constituent units of the repeating design.

19. A method for manufacturing a timepiece dial comprising:

a microlens layer preparing process for preparing a microlens layer having a first surface and a second surface being opposite to the first surface, the microlens layer including a plurality of microlenses arranged on the first surface in an orderly fashion as viewed in a planar view, the second surface being flat, the microlens layer being integrally formed as a one-piece, unitary member; and a decorative layer forming process for forming a decorative layer on the second surface of the microlens layer, the decorative layer being formed as an independent member from the microlens layer, the decorative layer including a repeating design having a plurality of constituent units in an orderly fashion, the microlens layer and the decorative layer being superimposed as viewed in the planar view, each of the constituent units of the repeating design of the decorative layer being flat;

the constituent units of the repeating design having an arrangement, which is the same arrangement as the microlenses, compressed or expanded in an in-plane predetermined direction of the decorative layer, $P_{ML}$ (μm) being the pitch of the microlenses, $P_R$ (μm) being the pitch of the constituent units of the repeating design, the timepiece dial having a region, as viewed in the planar view of the timepiece dial, a value of $P_{ML}-P_R$ being gradually reduced from a center of the timepiece dial to a circumference part in the region, the constituent units of the repeating design being spaced apart from each other on the second surface of the microlens layer such that the second surface of the microlens layer exposes through a spacing defined between an adjacent pair of the constituent units of the repeating design.

* * * * *